US007494053B1

(12) United States Patent
Burns

(10) Patent No.: US 7,494,053 B1
(45) Date of Patent: Feb. 24, 2009

(54) CASH DISPENSING AUTOMATED BANKING MACHINE AND METHOD

(75) Inventor: Paul Burns, Munroe Falls, OH (US)

(73) Assignee: Diebold Self-Service Systems division of Diebold, Incorporated, North Canton, OH (US)

( * ) Notice: Subject to any disclaimer, the term of this patent is extended or adjusted under 35 U.S.C. 154(b) by 69 days.

(21) Appl. No.: 11/598,914

(22) Filed: Nov. 13, 2006

Related U.S. Application Data

(60) Provisional application No. 60/736,609, filed on Nov. 14, 2005.

(51) Int. Cl.
*G06Q 40/00* (2006.01)
*G07D 11/00* (2006.01)

(52) U.S. Cl. ..... 235/379; 235/380

(58) Field of Classification Search ..... 235/379, 235/380; 705/43

See application file for complete search history.

(56) References Cited

U.S. PATENT DOCUMENTS

| | | | | |
|---|---|---|---|---|
| 6,061,666 | A * | 5/2000 | Do et al. | 235/379 |
| 6,474,547 | B1 * | 11/2002 | Suzuki | 235/379 |
| 6,478,221 | B1 * | 11/2002 | Sommerville | 235/379 |
| 2002/0073032 | A1 * | 6/2002 | Holmes et al. | 705/43 |
| 2004/0129774 | A1 * | 7/2004 | Utz et al. | 235/379 |

* cited by examiner

*Primary Examiner*—Seung H Lee
*Assistant Examiner*—Christle I Marshall
(74) *Attorney, Agent, or Firm*—Christopher L. Parmelee; Ralph E. Jocke; Walker & Jocke LPA

(57) ABSTRACT

A cash dispensing automated banking machine is provided that is capable of dispensing cash to users operating the machine. The machine includes a plurality of output devices including a display screen and a speaker output device and/or a headphone port. The machine also includes at least one input device capable of receiving inputs which cause the machine to dispense cash. The machine also includes features which facilitate operation of the machine by visually impaired users, such as proximity sensors adjacent the input and output devices. The machine is responsive to the detection of a portion of a user adjacent to a device of the machine to cause an audible output associated with the device.

37 Claims, 11 Drawing Sheets

CASH DISPENSING AUTOMATED BANKING MACHINE AND METHOD

CROSS REFERENCE TO RELATED APPLICATIONS

This application claims benefit of U.S. Provisional Application Ser. No. 60/736,609 filed Nov. 14, 2005, which is hereby incorporated herein by reference.

TECHNICAL FIELD

This application relates to automated banking machines. Specifically, at least one embodiment relates to a cash dispensing automated banking machine apparatus that provides improvements in user operation.

BACKGROUND ART

Automated banking machines are well known. A common type of automated banking machine used by consumers is an automated teller machine ("ATM"). ATMs enable customers to carry out banking transactions. Common banking transactions that may be carried out with ATMs include the dispensing of cash, the receipt of deposits, the transfer of funds between accounts, the payment of bills and account balance inquiries. The type of banking transactions a customer can carry out are determined by capabilities of the particular banking machine and the programming of the institution operating the machine. Other types of automated banking machines may allow customers to charge against accounts, to pay bills, to transfer funds or to cash checks. Other types of automated banking machines may print or dispense items of value such as coupons, tickets, wagering slips, vouchers, checks, food stamps, money orders, scrip or travelers' checks. For purposes of this disclosure, references to an ATM, an automated banking machine or automated transaction machine shall encompass any device which carries out transactions including transfers of value.

ATMs generally include a display device which is operative to output a visual user interface. The user interface includes instructions and selectable options which visually guide a user through the operation of the machine. For example, ATMs often include a hierarchical menu for navigating through a plurality of different user interface screens. Such menus often list various types of transaction functions which may be performed at the ATM such as a withdrawal of cash or the deposit of a check. Although a consumer with normal vision can readily operate such an ATM by following the commands visually presented through the display device, a consumer who is visually impaired may not be able operate such an ATM as easily. As a result, there exists a need for an ATM which is capable of being operated by consumers with either normal or impaired vision.

DISCLOSURE OF INVENTION

It is an object of an exemplary embodiment to provide an automated banking machine at which a user may conduct transactions.

It is a further object of an exemplary embodiment to provide an automated banking machine that may be operated by consumers with normal vision.

It is a further object of an exemplary embodiment to provide an automated banking machine that may be operated by consumers with impaired vision.

Further objects of exemplary embodiments will be made apparent in the following Best Modes for Carrying Out Invention and the appended claims.

The foregoing objects are accomplished in an exemplary embodiment by an automated banking machine that includes output devices such as a display screen, and input devices such as a touch screen, a keyboard, card reader or other type input device. The banking machine may further include devices such as a cash dispenser mechanism for sheets of currency, a printer mechanism, a depository mechanism and other transaction function devices that are used by the machine in carrying out banking transactions.

The banking machine is in operative connection with at least one computer. The computer is in operative connection with the output devices and the input devices, as well as with the cash dispenser mechanism, and other physical transaction function devices in the banking machine. The computer includes software programs that are executable therein. The software may include terminal control software which is operative to cause the machine to perform a plurality of different transaction functions. In addition, the terminal control software of the exemplary embodiment may be operative to cause the machine to provide both a visual and audible user interface for guiding a consumer through the operation of the machine.

In one exemplary embodiment, the terminal control software may be operative to cause the computer to output a visual menu for navigating between different user interface screens. Such screens may include transaction information and selectable options for operating the automated banking machine. For each visual user interface screen, the exemplary embodiment of the terminal control software may be operative to cause the computer to output corresponding audible outputs through external loudspeakers and/or an output device that is connectable to a set of headphones. The audible outputs may include verbal instructions which describe the functions and operations available for the current state of the banking machine. Such audible verbal instructions may further include a description of which keys, buttons, transaction function devices, and other input devices to press, manipulate, or activate in order to perform the available machine functions and operations. In addition, such audible verbal instructions may further include a description of the relative locations of the keys, buttons, transaction function devices, and other input devices for performing the functions and operations. Further, such verbal instructions may include a description of how to use or manipulate the keys, buttons, transaction function devices, and other input devices of the banking machine. For example, to initially activate the automated banking machine, the audible verbal instructions may include a description of the location of a card reader of the machine and indicate in what orientation a card may be inserted and/or swiped in the card reader for purposes of being read. Further audible verbal instructions may describe the types of transaction functions that are available and which keys or other input devices must be pressed or manipulated in order to either select, modify, or cancel each of the transaction functions.

As used herein, the term "verbal" corresponds to spoken human language words generated by either a human voice or machine synthesized human voice emulation. In exemplary embodiments, audible verbal instructions may include a plurality of spoken words produced responsive to digital or analog recordings of either a human voice or computer synthesized voice. In addition, audible verbal instructions may be produced directly from hardware devices and/or software programs operating in the ATM which are capable of synthesizing human language words, sentences, syllables and other human language communication sounds. Such hardware devices and/or software programs for example may include text to speech synthesizer devices which are operative to generate sound signals or audible outputs which include verbal instructions responsive to alphanumeric text.

The exemplary embodiment may include a plurality of features which enable the machine to be easily and conveniently used by the visually impaired. For example, in the exemplary embodiment, the automated banking machine may enable a consumer to repeat the last audible verbal instructions with the press of a single button and/or key. Also, for each key press or other input, the banking machine may be operative to audibly identify the letter, number, and/or function of the key.

In the exemplary embodiment, the automated banking machine may enable the consumer to cycle through a plurality of volume changes with the press of a single button and/or key. Further, the banking machine may be operative to automatically mute any external loudspeakers of the banking machine upon the detection of the operative connection of headphones to the machine by a user. In addition, the exemplary embodiment of the banking machine may be operative to set the headphone volume at a pre-determined low level with each new consumer session. The consumer may then press the volume key and/or button to increase the volume level of the headphones to a desirable level.

In exemplary embodiments, the banking machine may further be operative to automatically stop displaying visual information through the display screen of the banking machine responsive to the detection of the operative connection of headphones to the machine by the user. For example, all or portions of the visual information typically displayed through the display screen regarding the operation of the machine and/or transaction information may be hidden from view when headphones are placed in connection with the machine. When the headphones are removed from connection with the machine, the automated banking machine may be operative to automatically display the normal visual information of the machine for its current state.

The exemplary embodiment may include a new audio system which enables the automated banking machine to have one or more of the previously described audible features. The new audio system may be operative to accept and adjustably mix together inputs from a plurality of audio sources, including multimedia inputs such as MP3 streams, voice inputs such as from WAV files, and system keyboard and/or prompting beeps. An exemplary embodiment of the audio system may further include both external and headphone connection ports which are operative to individually and selectively amplify and output the mixed signals through external loudspeakers and headphones placed in operative connection with connection ports.

The audio system may be operative to detect the connection of a headphone to the headphone port, automatically mute the output to the external port which is connected with external speakers, and set the headphone volume at a minimum level. In addition, the exemplary audio system may be operative to detect the removal of the headphone from connection with the headphone port, and automatically reinstitute the output through the external port.

An exemplary embodiment of a cash dispensing automated banking machine may be operative to output audible outputs (also refereed to herein as audio outputs) which assist a user in locating devices on the automated banking machine. Such an automated banking machine may include at least one computer and a cash dispenser in operative connection with the at least one computer. In addition the automated banking machine may include at least one output device in operative connection with the at least one computer. Also, the automated banking machine may include a plurality of proximity sensors in operative connection with the at least one computer. Further, the automated banking machine may include a plurality of user accessible devices in operative connection with the at least one computer. Such devices may include the cash dispenser in addition to one or more other devices accessible to a user on an automated banking machine such as a card reader, keypad, receipt printer, headphone jack, display screen, and depository mechanism. At least some of these devices is associated with a respective at least one proximity sensor.

In this described exemplary embodiment, each at least one proximity sensor associated with a respective device is operative to detect the presence of a portion of a user (e.g. hand, finger(s) and/or arm of a user) moved adjacent the respective device. The at least one computer is operative responsive to each of the at least one proximity sensors detecting the presence of a portion of a user moved adjacent a respective device to cause at least one audio output to be communicated through the at least one output device responsive. This audio output may correspond to a verbal name or description of the particular device adjacent the proximity sensor that detected a portion of a user. This, in this described embodiment, the automated banking machine automatically provides audible feedback responsive to the location of a user's hand or other portion of the user relative different devices and/or locations on the automated banking machine.

An alternative exemplary embodiment may include a method which includes steps corresponding to producing such audible feedback. Such a method may include a step of detecting with at least one first proximity sensor included on an automated banking machine, that a portion of a user is adjacent a first device on the automated banking machine. Responsive to this step, the method may include a further step of outputting through at least one output device, a first audio output that includes first verbal information indicative of an identifying name for the first device.

For example, in these described embodiments when the hand or other portion of the user passes near the cash dispenser, the automated banking machine may be operative to cause an audio output to be produced through an external speaker and/or headphones, which output states "cash dispenser". Also when the hand or other portion of the user passes near the keypad, the automated banking machine may be operative to cause an audio output to be produced through the external speaker and/or headphones, which output states "keypad".

BEST MODES FOR CARRYING OUT INVENTION

Figure 1:
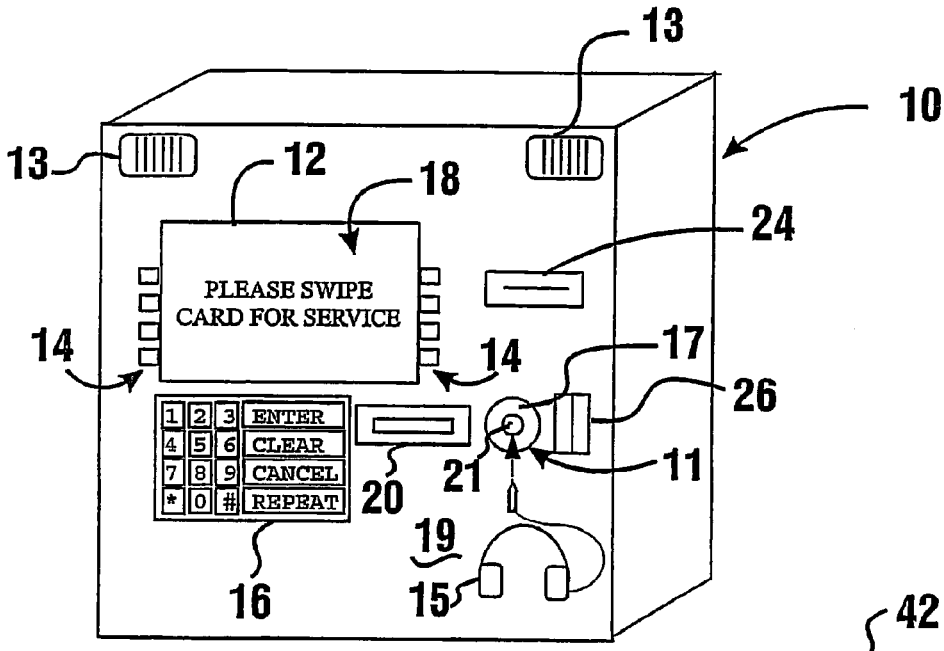
FIG. 1 is a perspective view representative of an exemplary embodiment of an ATM incorporating features of an exemplary embodiment.

Referring now to the drawings and particularly to FIG. 1, there is shown therein a perspective view of an exemplary embodiment of an automated banking machine such as an automated teller machine (ATM) 10. An exemplary embodiment of the ATM 10 includes output devices such as a display device 12 and external loudspeakers 13. The display device 12 is operative to provide a consumer with a user interface 18 that includes a plurality of screens or other outputs including selectable options for operating the machine. The external loudspeakers 13 may be operative to provide a consumer with audible music, beeps, signals, and/or verbal instructions for operating the machine.

The exemplary embodiment of the ATM 10 may further include at least one output device such as an external port 11. In the exemplary embodiment of the ATM 10, the external port 11 includes a speaker port such as a headphone port or jack 21 for operatively connecting portable speaker devices such as a set of headphones 15 to the ATM. In other exemplary embodiments, the external port 11 may comprise a wireless connection port. For example, in an alternative exemplary embodiment of the ATM 10, the external port 11 may include a wireless communication device which is operative to communicate with a wireless headphone set or other external device capable of providing audible, visual or other user perceivable outputs. Such wireless communication devices may communicate with the external device using RF or IR, for example.

Figure 15:
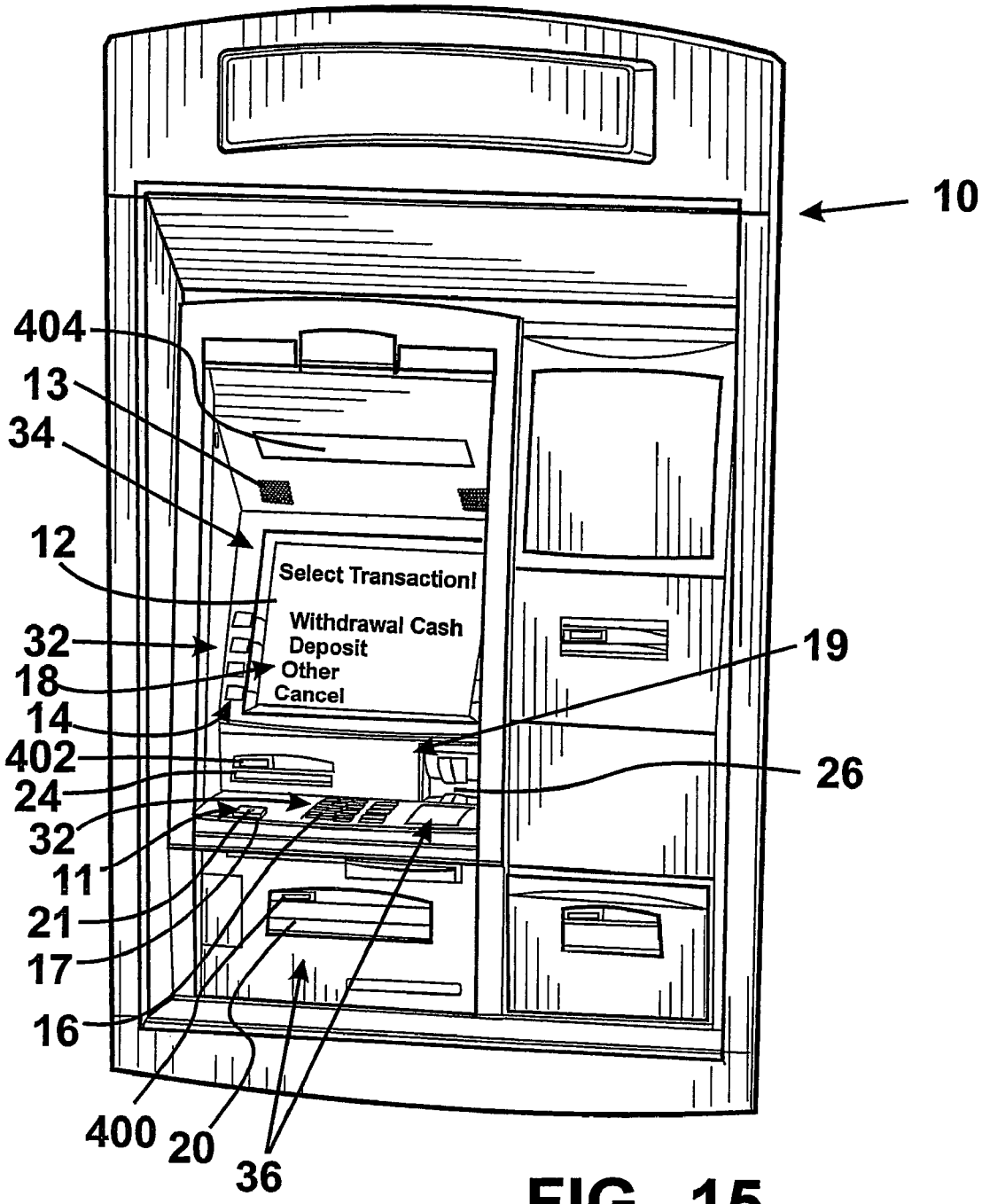
FIG. 15 is a perspective view representative of an alternative exemplary embodiment of an ATM.

As shown in FIG. 1, in exemplary embodiments of the ATM, the external port 11 may include a base 17 with a useful shape that is not flush with the fascia 19 of the ATM 10. The shape of the base 17 may have a distinctive contour which enables a consumer with impaired vision to quickly locate the external port by touching the fascia 19 and base 17 of the ATM. For example, in one exemplary embodiment, the base of the external port may include a concave portion with a female headphone jack or port 21 positioned generally in the center of the concave portion. As shown in FIG. 15, in further exemplary embodiment of an ATM, the base 17 of the external port 11 may extend from the fascia 19 and have a contour of a raised rectangle. In other exemplary embodiments, the external port may have a raised or inset base with a distinctive contour or shape such as that of a square, circle, triangle, or other unique shape that is identifiable by touch.

The exemplary ATM 10 may include a plurality of input devices such as function keys 14 and a keypad 16. The exemplary embodiment of the ATM 10 may further include other types of input devices, such as a touch screen, microphone, card reader 26, biometric reader or any other device that is operative to provide the ATM with inputs representative of user instructions or information. The exemplary ATM 10 may further include a plurality of transaction function devices, such as a sheet or cash dispenser 20, receipt printer 24, depository and other devices.

Figure 16:
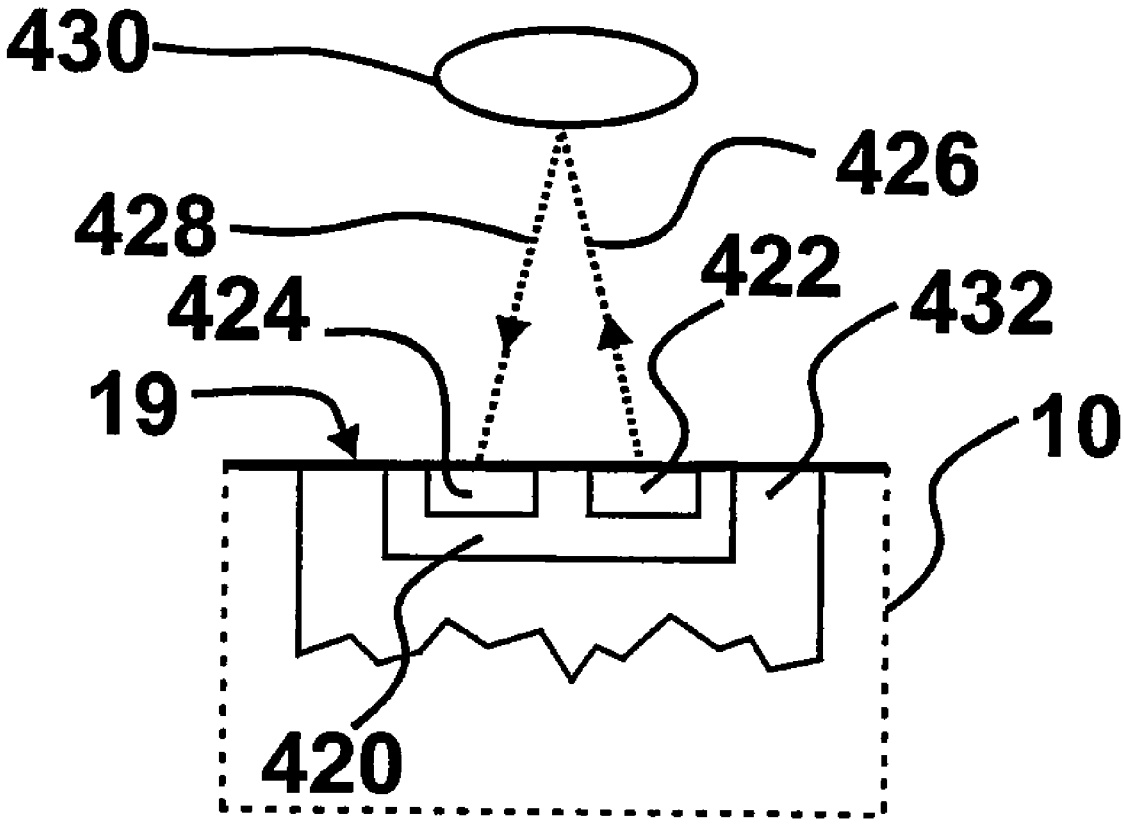
FIG. 16 is a schematic view representative of an exemplary embodiment of a proximity sensor adapted to trigger audio outputs verbally naming devices responsive to a portion of a user adjacent the devices.

The ATM shown in FIG. 1 includes a swipe card reader 26 in which the user must manually slide the card through a slot in the reader. FIG. 15 shows a further exemplary embodiment of an ATM 10 with these described features and devices. As shown in FIG. 16, the portion of the cash dispenser (20) that is viewable from the front of the ATM may correspond to a cash outlet from which cash is dispensed. Also, the ATM is shown in FIG. 15 includes a motorized card reader 26 operative to take a card partially inserted into the reader by a user and completely move the card inside the card reader. Exemplary embodiments of the ATMs described herein my include a swipe card reader, a motorized card reader, or other types of reader devices which are operative to acquire user identifying information from the user or an object associated with a user. For example, in an alternative exemplary embodiment, the card reader may include an RFID reader or other wireless reader device that is capable of wirelessly retrieving account information from a card or other object placed near the reader. In further exemplary embodiments, biometric data captured from the user using a biometric reader device on the ATM may be used to retrieve account information associated with the user.

Figure 2:
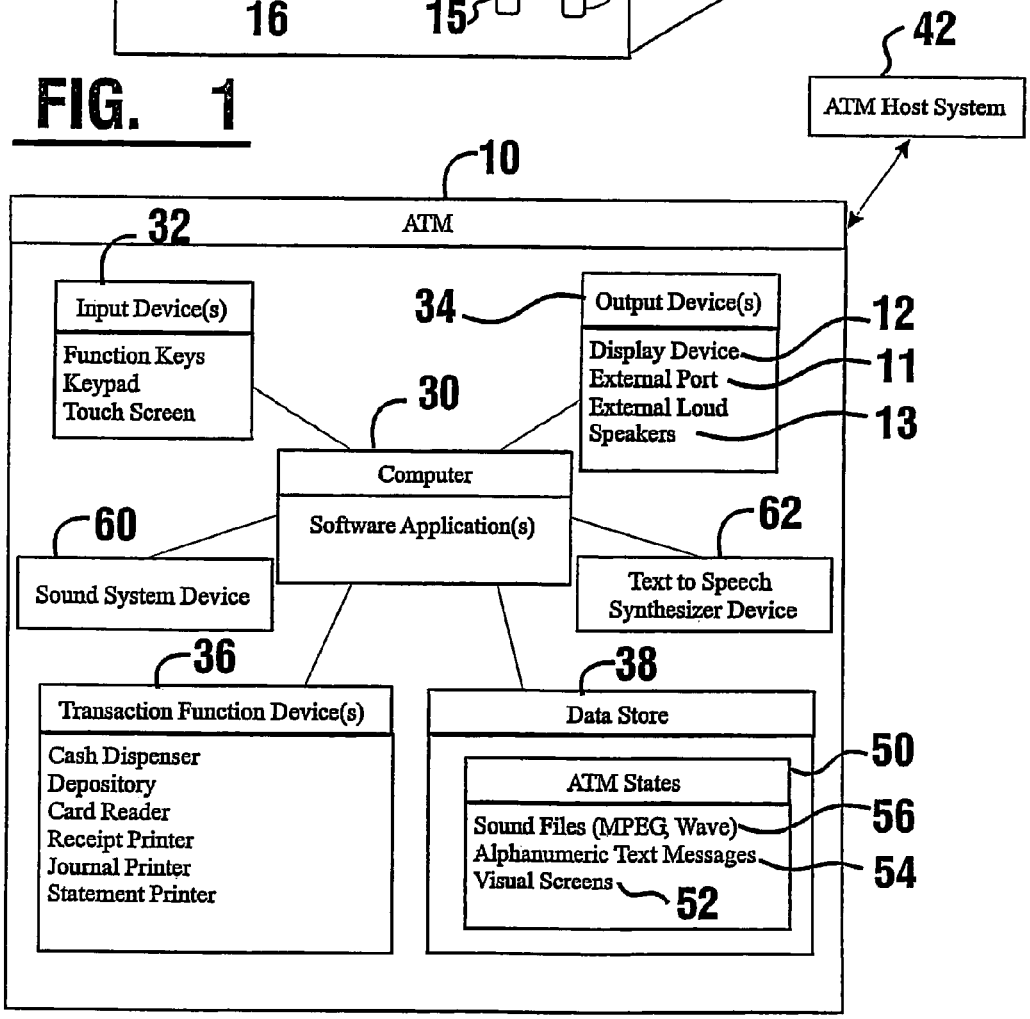
FIG. 2 is a schematic view of the exemplary embodiment of the ATM.

FIG. 2 shows a schematic view of components which may be included in an exemplary embodiment of the ATM and a system in which it is operated. The ATM 10 may include at least one computer 30. The computer 30 may be in operative connection with the input device(s) 32, the output device(s) 34, the transaction function device(s) 36 and at least one data store 38. The exemplary embodiment further includes one or more software application(s) 40 operative in the computer 30. The software applications may include for example terminal control software, maintenance software, diagnostic software and any other software that enables the ATM to perform transaction functions for users and/or enables authorized representatives of an operator of the ATM to service, configure and maintain the ATM. An exemplary embodiment of an ATM may be operative to communicate with a host banking system 42 to enable a consumer to perform such exemplary transaction functions as withdrawing cash from an account through operation of the cash dispenser device 20, depositing checks or other items with a depository device, performing a balance inquiry for a financial account and transferring value between accounts.

The exemplary embodiment may be operative to provide a consumer with a user interface that may be visually displayed and/or output in audible form for the consumer. The exemplary user interface may guide the consumer through the selection of one or more functions which are to be performed by the ATM. Such functions may include a plurality of different transaction functions such as the dispense of cash, balance inquiries, deposits and transfers. However, such functions may also include options for navigating through the user interface such as functions for canceling or confirming a selection. Functions may also include options for configuring the user interface, such as changing the human language output through the user interface or changing the volume of the audio output of the ATM. In addition, functions may also include options for making the user interface more user friendly, such as functions that repeat an audible instruction, or that provide help or a description for other functions of the ATM.

The exemplary embodiment of the ATM includes at least one software application such as a terminal control software program that at any given time is operative to be in one of a plurality of different states. To perform transaction functions, the terminal control software may progresses between the various states, prompting the user to input different types of information in some states and performing a transaction function in other states in response to the inputted information.

The exemplary embodiment of the ATM may operate to organize different transaction functions into a hierarchy using a plurality of menus and sub-menus (also referred to herein as "screens"). A menu may be visually and/or audibly output to the consumer for each of the different states the ATM is operative to progress through to select and perform the transaction functions. Each menu may be operative to list those functions which may be performed in any given state of the ATM. Selecting an option or function visually listed or verbally described in a menu may cause the ATM to change to a different state which causes a display and/or output of an audible verbal description of a sub-menu of options or functions available to be performed by the ATM in the new state.

The exemplary data store 38 of the ATM may be operative to store therein, information for generating visible outputs and audible outputs that are representative of menus and sub-menus for a plurality of different states 50 of the ATM. Such information, for example may include stored data for producing visible outputs such as visual screen data 52 for operative states of the ATM. Such information may further include stored data for producing audio outputs such as MP3 or WAV sound files 56 which include verbal instructions for operative states of the ATM. Such stored data for producing audio outputs may also include alphanumeric text messages 54 (also referred to herein as "text-to-speech data"), which may be used by the computer 30 to generate audible verbal instructions for operative states of the ATM. In exemplary embodiments, the visual screen data 52 may be accessed by the computer and used to produce visible outputs through the display device 12. Also, the audio output data such as the sound files 56 and/or text messages 54 may be accessed by the computer and used to produce audible outputs with verbal instructions or descriptions through external loudspeakers 13 and/or headphones. In an exemplary embodiment, the ATM may received visual screen data and/or audio output data from a host banking system.

As shown in FIG. 2, the ATM 10 may further include a sound system device 60 in operative connection with the computer. The exemplary sound system device 60 may be operative to produce signals that produce audible outputs. Such signals may be directed to the external port 11 and/or the external loudspeakers 13. In one exemplary embodiment, the sound system device may be operative to selectively mix and amplify a plurality of different audio input signals to generate an amplified audible output signal. Alternative exemplary embodiments of the ATM 10 may further include a text to speech synthesizer device 62 which is operative to convert the text messages 54 into the verbal instructions or descriptions included in the audible outputs of the ATM.

The exemplary embodiment of the ATM 10 may be designed to be used by consumers with normal vision as well as users who have impaired vision or who are blind. For example, a user with normal vision may view the display screen to read instructions for operating the ATM 10. A user with impaired vision may listen to verbal instructions and descriptions output from the external loudspeakers 13. In addition, a user with impaired vision may operatively connect a personal set of headphones 15 or other device with the external port 11 of the ATM to listen to verbal instructions and descriptions in private. As used herein, the phrases "verbal instructions" or "verbal descriptions" are used interchangeably, and may include verbal instructions, commands, descriptions, and/or any other verbal information.

In an exemplary embodiment, the sound system device 60 may be operative to detect the impedance change across the external port 11 when headphones 15 are electrically connected to the external port. When the connection is detected, the sound system device 60 and/or computer 30 may be operative to mute any audible output being directed to the external loudspeakers 13. The computer may then be operative to output private verbal instructions through the headphones which describe to the user how the ATM may be operated. In exemplary embodiments, muting an audible output may include the computer or the sound system device operating to lower the volume level of the audible output through the external speakers to a generally silent level. Muting an audible output may also include stopping the playing or production of audio outputs by the computer or the sound system device.

Upon detection of the connection of the headphones or other external device to the external port, the sound system and/or the computer may be operative to change the volume level of the audible output being directed to the headphones or other device through the external port to a predetermined level. Such a predetermined level may correspond to a relatively low volume level that is not likely to cause discomfort to the majority of consumers using the ATM. In the exemplary embodiment, the sound system may be in operative connection with one or more volume changing switches, keys, dials, buttons or other devices which are accessible to the consumer. After the operative connection of the headphones or other device to the external port, the volume changing devices may be operated by the consumer to increase or decrease the volume level as desired by the consumer. In an exemplary embodiment, the sound system device may further be operative to detect when the headphone has been disconnected with the external port. When this occurs the sound system and/or the computer may be operative to mute the audible output to the external port and institute the audible output through the external loudspeakers.

In alternative exemplary embodiments, a key of a keypad of the ATM may be operative to control the volume of audio outputs. When a designated volume key of the keypad or other key is pressed or actuated, the computer may be operative to cause the ATM to change the current volume level and audibly output a word such as "Volume" at the newly selected volume level. For example, when a consumer presses the volume key of the keypad twice in succession, an exemplary embodiment of the banking machine may be operative to output the word "Volume" twice with the second occurrence of the word "Volume" being louder than the first occurrence. When the volume has reached a maximum level, the next time the volume key of the keypad is pressed, the exemplary ATM may be operative to return the volume level to a predetermined minimum usable volume level and output a word such as "Volume" at the corresponding minimum volume level.

Figure 3:
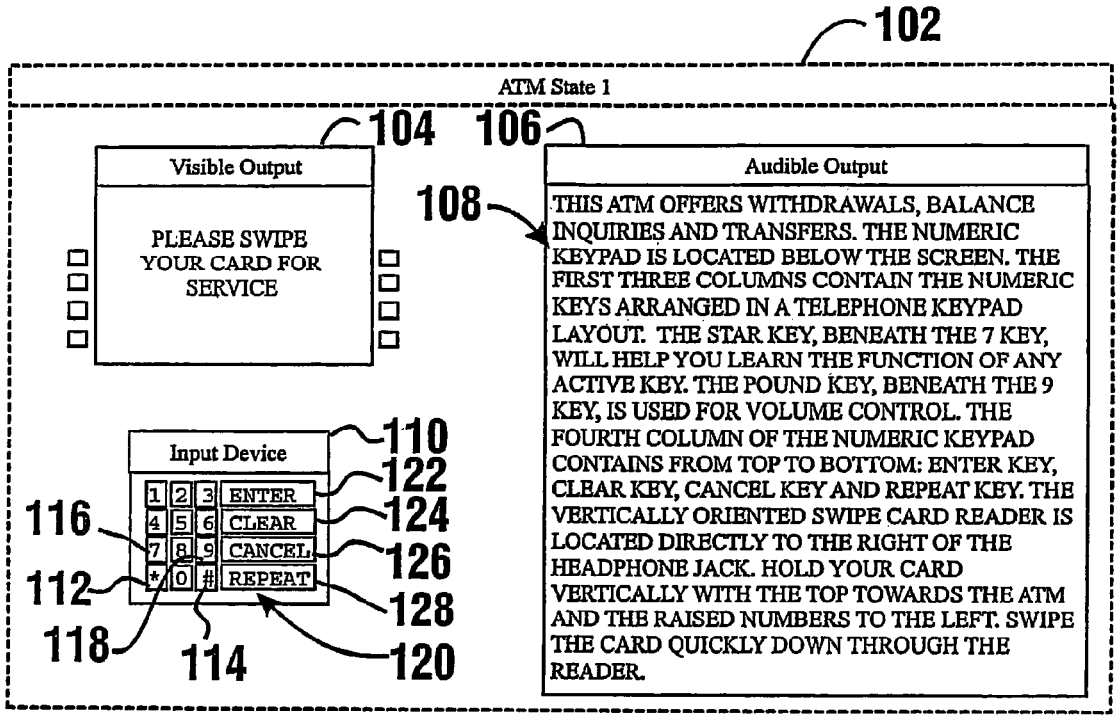
FIGS. 3-13 are schematic views of the exemplary embodiment of the ATM in a plurality of different states of operation.

FIGS. 3-8 show schematic views of the ATM 10 in a plurality of different states. Such states are examples of one exemplary path a consumer may take through the hierarchy of user interface menus for purposes of operating the ATM 10. FIG. 3 shows the ATM 10 in a first mode or state 102 which may be active when a user first approaches the machine. Here the ATM is operative to attract or invite consumers to use the services of the ATM. The exemplary embodiment of the ATM may include a visible output 104 through a display device of the ATM. The visible output may include indicia such as text which informs the consumer that the card may be swiped (or inserted) for initiating operation of the machine.

For users that are visually impaired, the exemplary ATM may further be operative to output an audible output 106 through external loudspeakers or headphones of the consumer. Such an audible output 106 may include verbal instructions 108 which inform the consumer which types of transaction functions can be performed at the machine. The verbal instructions 108 may also describe the locations of input devices such as a keypad 110 of the ATM and may describe the physical locations and/or configurations of the input devices. In addition, the verbal instructions may describe how the input device may be manipulated to select different functions of the machine and may further describe what the functions perform. Also, the verbal instructions may describe the location of transaction function devices and describe how the transaction function devices may be used.

For example, in the state shown in FIG. 3, the verbal instructions may indicate that the ATM offers transaction functions such as withdrawals, balance inquiries and transfers. In addition the verbal instructions may indicate that the keypad 110 is located below the display device. Further, the verbal instructions may indicate that the keypad is organized similar to a telephone keypad. Also, the verbal instructions may describe the locations of certain keys of the keypad, including their function. For example, the star "*" key 112 may be indicated to be below the seven "7" key 116 and is operative to help the consumer learn the function of any active key. The pound "#" key 114 may be indicated to be below the nine "9" key 118 and is used for volume control. A fourth column 120 of keys in the exemplary keypad may be described as including from top to bottom an enter key 122, a clear key 124, a cancel key 126, and a repeat key 128. In exemplary embodiments, the verbal instructions 108 may further indicate that the swipe card reader is vertically orientated and is located to the right of the headphone jack. In exemplary embodiments, audible outputs may also indicate that the swipe reader is to be used by holding a credit or debit card vertically with the top toward the ATM and with the raised numbers to the left and by swiping the card quickly down through the slot in the reader. Of course these outputs are exemplary and in other embodiments other approaches may be used.

Figure 4:
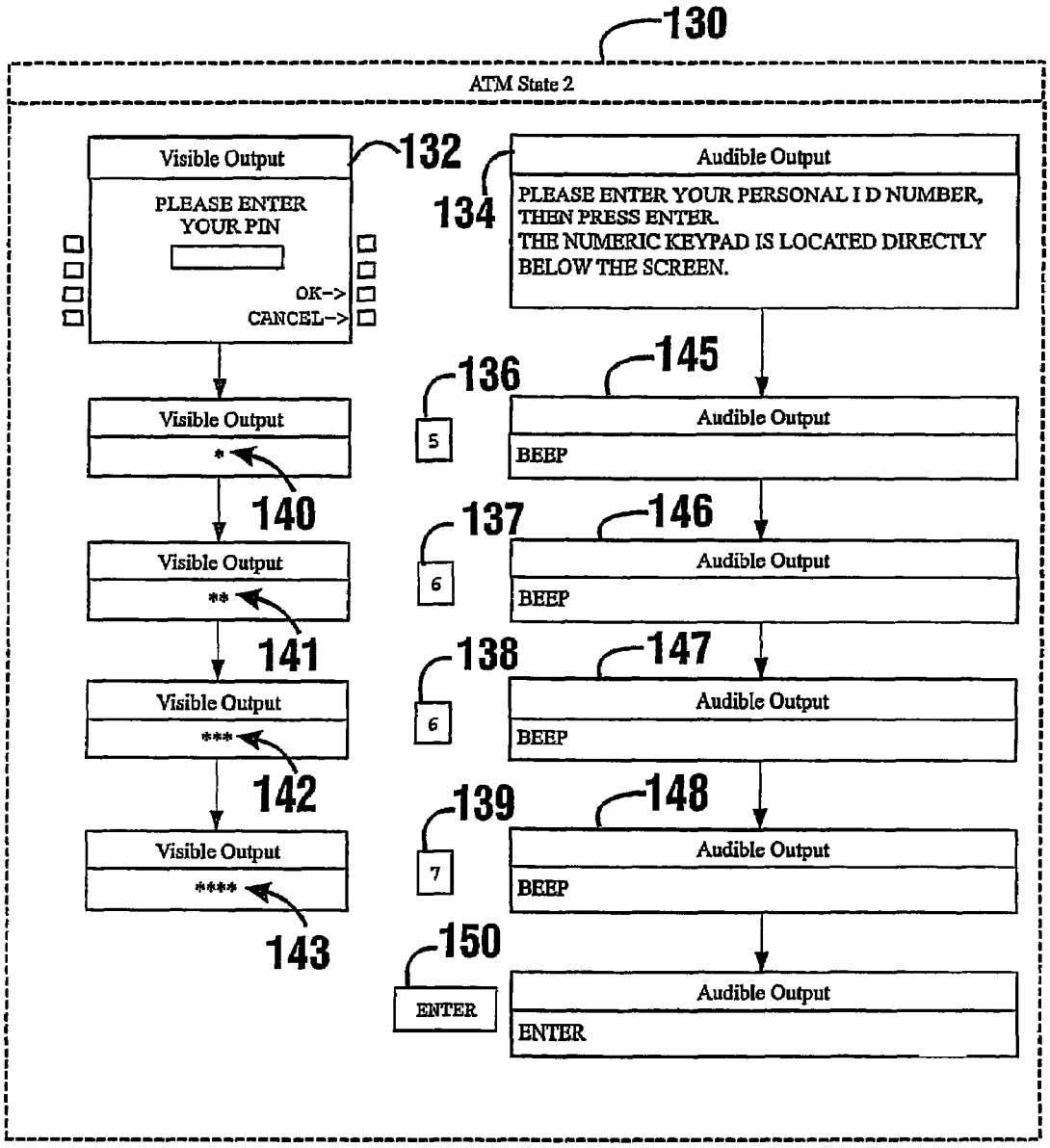

As shown in FIG. 4, the exemplary ATM may be operative to change to a second state 130, after the consumer successfully swipes and/or inserts a card using the card reader of the ATM. In this second state 130, the ATM may be operative to accept the input of a Personal Identification Number (PIN). Both the visible output 132 and the audible output 134 produced when the ATM is in this state, may request that the consumer enter a PIN. As a consumer presses each of the numeric keys 136-139 of the keypad which correspond to the consumer's PIN, the exemplary ATM may be operative to both visually and audibly acknowledge each input. For example, the visible output 132 may be updated with each key press to display an additional asterisk symbol 140-143. In addition, with each key press the ATM may be operative to produce additional audible outputs 145-148 which may include a beep, or other sound acknowledging each input. When the audible output is privately being communicated to the user through headphones for example, the audible outputs 145-148 may correspond to the verbal description of each number being pressed. When the user presses the enter key 150, the exemplary ATM is operative to produce a further audible output which includes a verbal description representative of the enter key such as for example the word "ENTER."

In an alternative exemplary embodiment, upon the detection of the connection of the headphones or other external device to the external port, the computer of the ATM may be operative to cause all or portions of the visible outputs typically provided through the display device of the ATM for a particular state of the ATM to be hidden from view. Hiding the visible outputs is operative to increase the privacy of the visually impaired person using the ATM and prevent a person standing near the ATM from spying on the transaction being performed at the ATM by the visually impaired person.

In exemplary embodiments the computer may be operative to keep the entire screen blank while the headphones remain connected to the external port of the ATM. In other exemplary embodiments, portions of the display screen may continue to display non-confidential information while private information associated with a transaction and/or the operation of the machine is only provided verbally through the headphones rather than being displayed on the display screen.

Examples of private information that is not shown through the display screen may include inputted numbers associated with an amount of cash to withdrawal or the value of an item being deposited such as a check. Other examples of private information not shown through the display device may include an account balance or any other transaction information that an ATM is capable of displaying. Further other types of information not shown through the display device may include information which shows the current state of the ATM, such as whether the ATM is being used to withdrawal cash or deposit an item.

Upon detection of the headphones or other external device being disconnected from the external port, the computer of the ATM may be operative to redisplay the visible outputs through the display device of the ATM which correspond to the current state of the ATM.

In exemplary embodiments where the display screen is not completely made blank while headphones are connected, the ATM may be operation to display a visual message, advertisement, or other non-confidential information. For example a visual message may be displayed which states that the current visible output may be redisplayed by removing the headphones and/or by providing a specified input. For example, if the person using the ATM has at least some vision ability, the person may prefer to both view visible outputs related to the transaction through the display screen of the ATM and listen to the verbal instructions related to the transaction through headphones. In this embodiment, the computer of the ATM may be responsive to the detection of a specified input through one of the input devices of the ATM to cause the visual outputs for the current state of the ATM to be redisplayed while continuing to output verbal instructions to the headphones.

Figure 5:
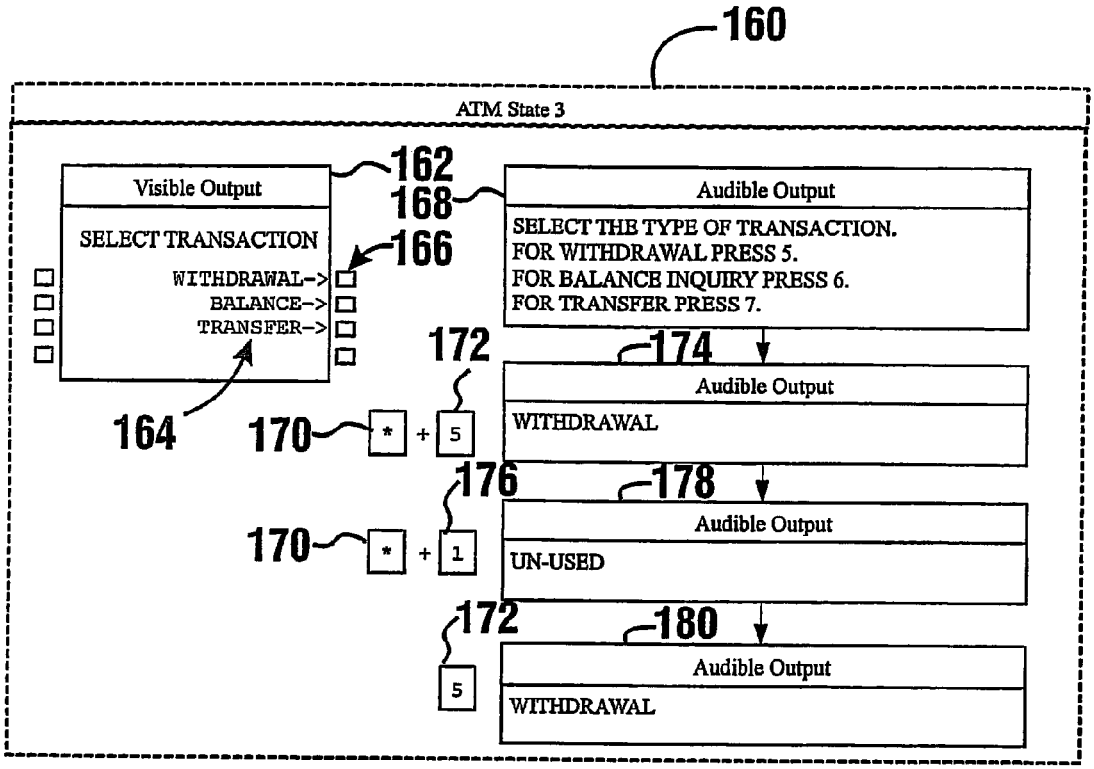

Referring to FIG. 4, once the consumer inputs a PIN and presses the enter key 150 of the keypad, the exemplary ATM may be operative to change to a third state in which the ATM is operative to enable the consumer to select one of a plurality of transaction functions to be performed with the ATM. As shown in FIG. 5, when the ATM is in a third state 160 the ATM may produce a visible output 162 which lists the transaction functions 164 and visually points to the function keys 166 that are operative to select each transaction function.

In the exemplary ATM, this described third state may cause the computer in the ATM to produce audible outputs 168 which describe which keys of the keypad are operative to select certain transaction functions. For example, in this described embodiment it may be indicated that the five "5" key may be actuated to select a withdrawal, the six "6" key may be actuated to select a balance inquiry, and the seven key "7" may be actuated to select a transfer.

In the exemplary embodiment, the ATM may be operative to provide a consumer with help to learn which keys perform which functions. For example, if the consumer wishes to verify that the five "5" key corresponds to a withdrawal transaction function without actually selecting a withdrawal transaction function, the consumer may press the star "*" key of the keypad prior to pressing the five "5" key. In this described exemplary embodiment the star "*" key may indicate to the ATM that the next following key is to be verbally described or named. As shown in FIG. 5, when the consumer presses the star "*" key 170 followed by the five "5" key 172, the ATM may be operative to produce a further audible output 174 which verbally indicates the name of the function such as "Withdrawal." When a help key such as the star "*" key 170 is actuated in this embodiment, the ATM may only describe the function associated with the next key press rather than changing to a further state corresponding to such a key press.

If the consumer presses the star "*" key 170 followed by a key that is not associated with a function in the current state, such as the one "1" key 176, the exemplary ATM may be operative to produce a further audible output 178. The further audible output may verbally indicate that the key is not being used in the current state of the ATM with an expression such as "Un-used."

In an exemplary embodiment, the second key for which the user wishes to receive an indication of the function must be pressed within a predetermined time period after the star "*" key 170 is pressed. Such a time period may for example be ten seconds. Of course, these approaches are exemplary and in other embodiments other approaches may be used.

Figure 6:
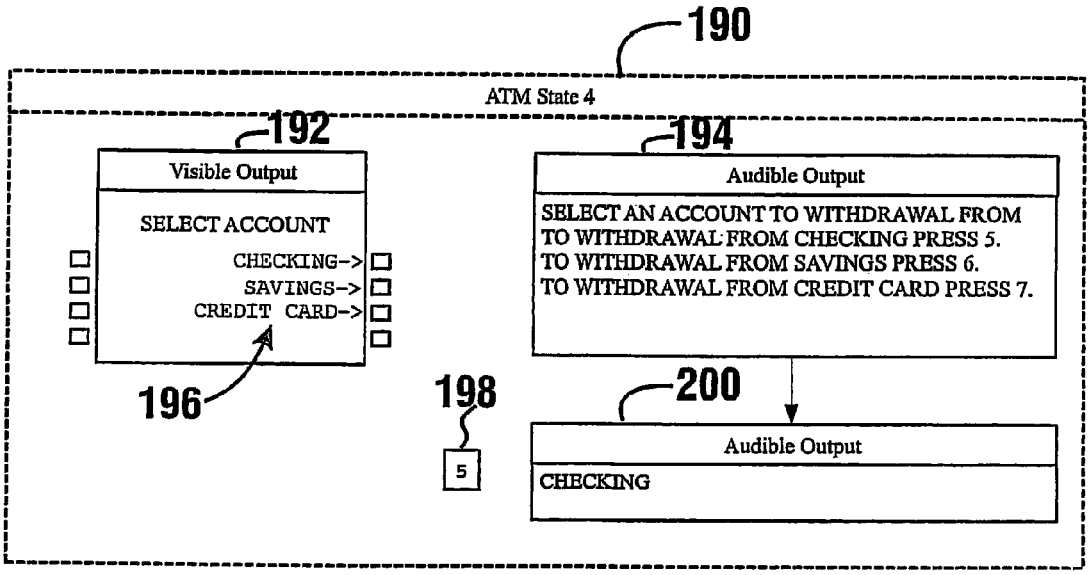

In the exemplary embodiment, when a consumer selects a transaction by pressing a key associated with the transaction, such as the five "5" key 172 without pressing the star "*" key 170, the ATM may be operative to change to a fourth state and produce another audible output 180 which verbally indicates to the user the name of the selected function. As shown in FIG. 6, the fourth state 190 may include a visual and an audible request that the consumer select or input additional information associated with the performance of the selected transaction function. With a withdrawal transaction, the fourth state may include a visible output 192 which lists the type of accounts 196 that the consumer may select for purposes of making the withdrawal. An audible output 194 may likewise verbally output a list of the types of accounts along with a corresponding key of the keypad to press for selecting each account. As discussed previously, when the consumer selects a key, the exemplary ATM may be operative to produce a further audible output 200, which verbally describes what the consumer has selected. For example, if the consumer presses the five "5" key 198, the audible output 200 may indicate the name of the selection by outputting a word such as "Checking."

Figure 7:
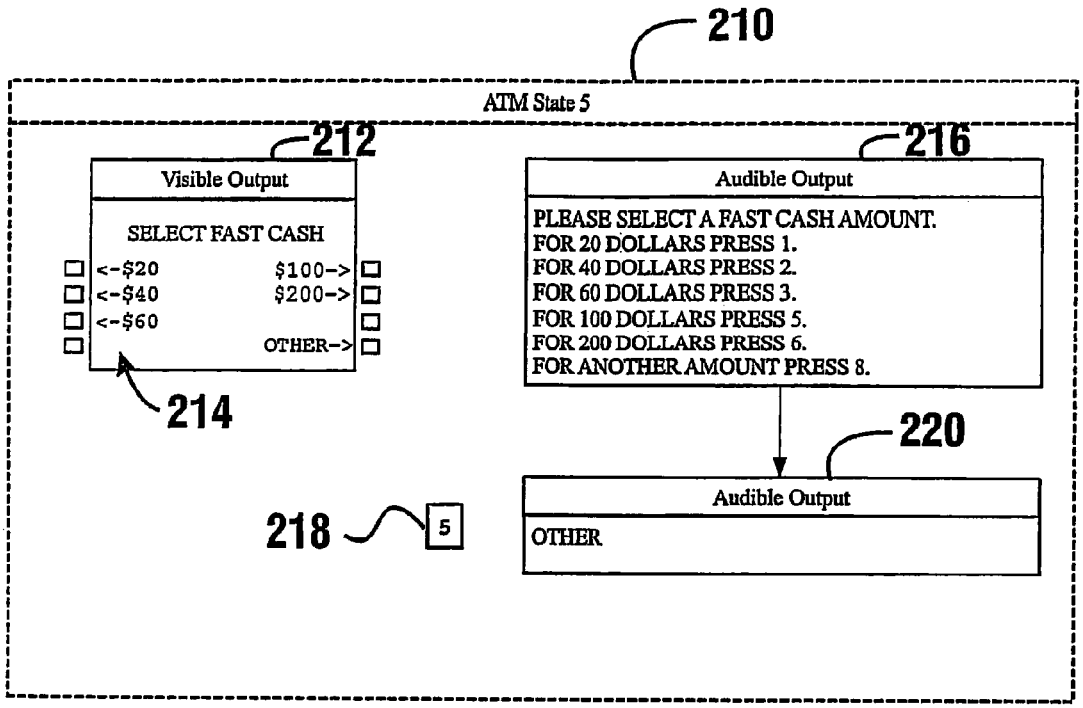

For a withdrawal transaction function, the exemplary embodiment may change to a further state after a selection of an account has been made. FIG. 7 shows an example of a fifth state 210, in which the ATM may be operative to accept the selection of an amount of cash to be withdrawn. Here, the ATM may be operative to produce a visible output 212 which lists a plurality of currency amounts 214 which may be selected. Likewise, the ATM may be operative to produce an audible output 216 which verbally indicates which keys of the keypad to press in order to select a particular currency amount.

Figure 8:
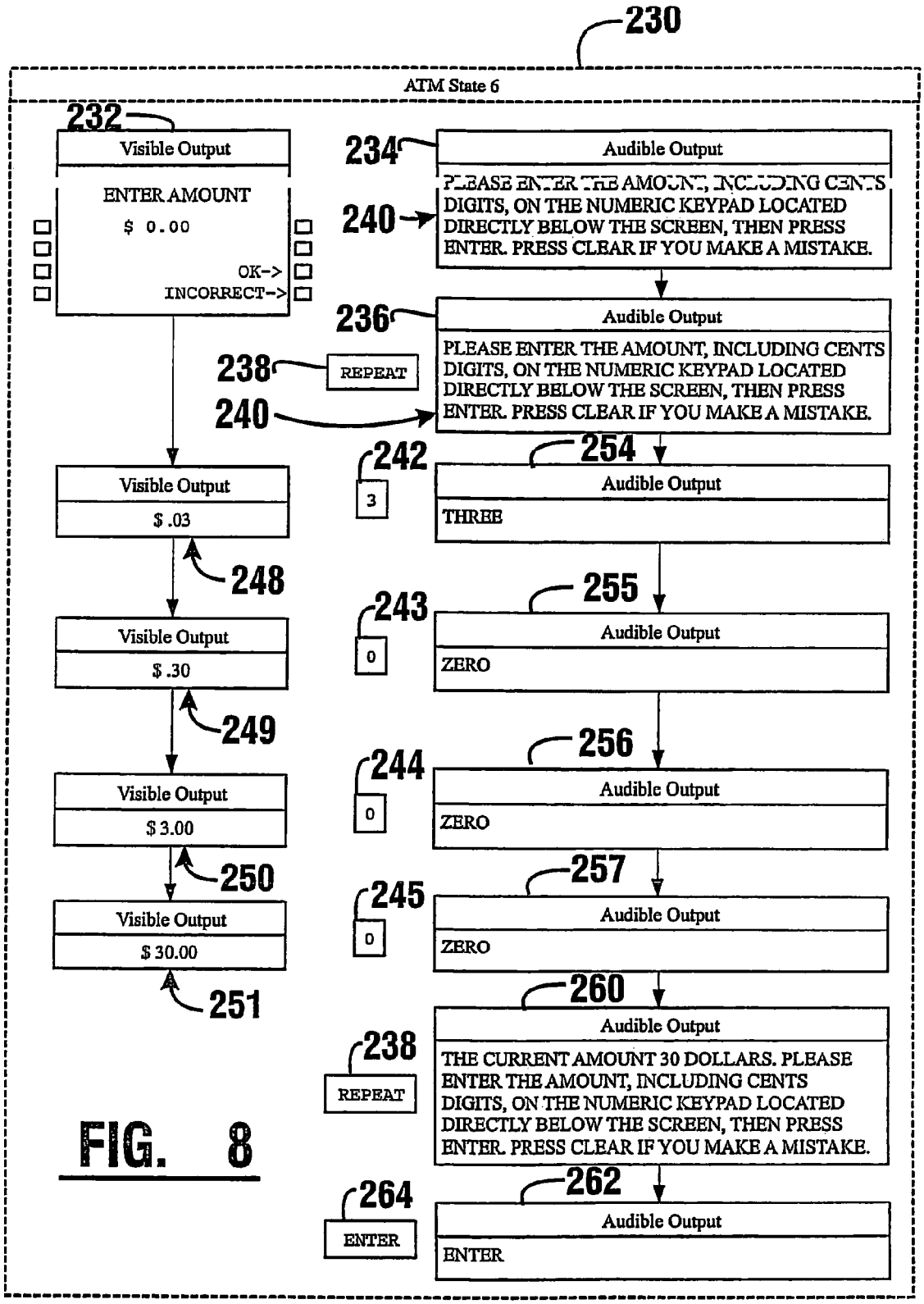

In this described exemplary embodiment, the five "5" key 218 corresponds to the selection of another amount for a withdrawal. When this key is pressed, while the ATM is in the fifth state, the ATM is operative to cause the ATM to change to a sixth state and is operative to produce a further audible output 220 which verbally describes this selection with a word such as "Other." As shown in FIG. 8, when the exemplary ATM is in a sixth state 230, the ATM may be operative to enable the consumer to enter a specific amount of cash to withdraw, which amount may be other than one of the predetermined amounts previously presented. Here, the ATM may be operative to produce a visible output 232 which requests that the consumer enter an amount for the withdrawal in a currency such as dollars. The exemplary ATM may further be operative to produce an audible output 234 which verbally requests that the consumer enter an amount which includes a fractional currency portion such as cents on the keypad.

If for some reason the consumer did not hear or understand all of the verbal instructions 240 of the audible output 234, the exemplary ATM may be operative to enable the consumer to cause the ATM to repeat the verbal instructions 240. In an exemplary embodiment, the ATM may be operative to produce a further audible output 236 which includes a repeat of the verbal instructions 240 responsive to the consumer pressing a repeat key 238 of the keypad. If the repeat key is pressed before the verbal instructions 240 in the audible output 234 have completed, the exemplary ATM may be operative to interrupt the audible output 234 and immediately begin outputting the further audible output 236. The further audible output 236 may then repeat the verbal instructions 240 from the beginning. In other exemplary embodiments, the ATM may be operative to produce further audible outputs 236 which include a repeat of the verbal instructions 240 responsive to actuation of any un-used key of the keypad which is not associated with another function or a selection available in the current state of the ATM.

When the consumer enters an amount of a withdrawal by pressing the number keys 242-245, the exemplary embodiment of the ATM may be operative to update the visible output 232 to produce visible outputs 248-251 with indicia representative of the current amount entered. In addition the ATM may be operative to produce further audible outputs 254-257 which verbally describe the number associated with the key that was pressed. In the exemplary embodiment, as each key is pressed, the ATM may be operative to determine a new current amount of value. The last two keys pressed may correspond to the fractional portion of the amount such as the cents portion in U.S. currency. The current amount may be stored in a memory or buffer in operative connection with the computer of the ATM. Pressing the repeat key 238 while a withdrawal amount has been or is being entered, may cause the ATM to produce a further audible output 260 which verbally indicates the current amount stored in the memory of the ATM. In an exemplary embodiment, the audible output 260 may also include a repeat of the verbal instructions 240.

Figure 9:
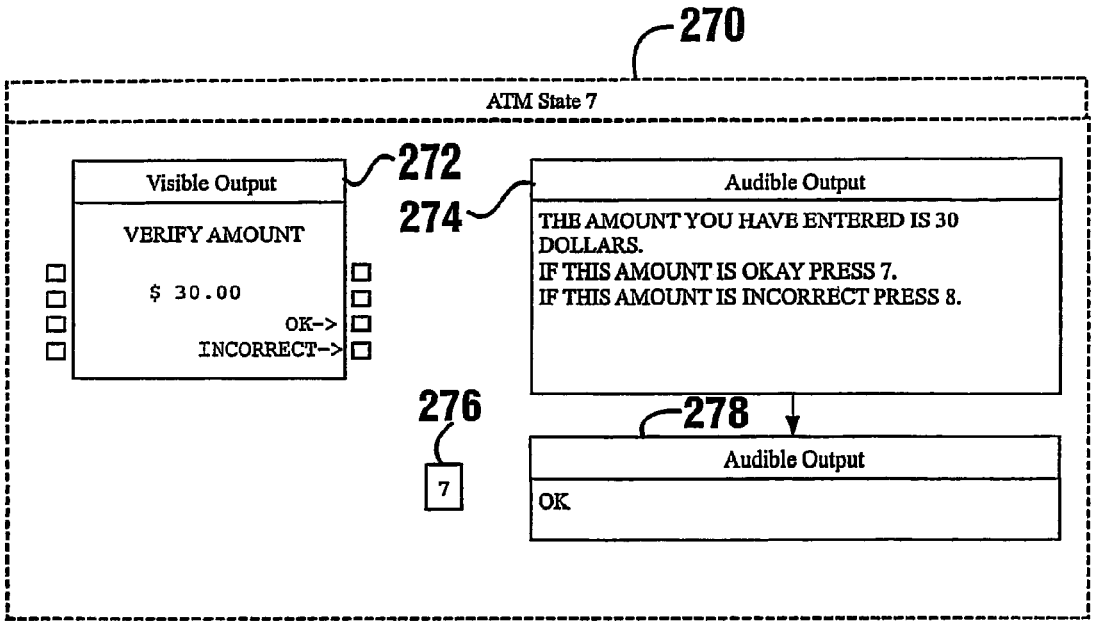

When the consumer has completed entering an amount, the consumer may press the enter key 264. Pressing the enter key may cause the ATM to change to a seventh state and produce another audible output 262 which verbally describes that the enter key has been pressed. FIG. 9 represents the ATM in a seventh state 270. Here, the exemplary embodiment of the ATM may be operative to produce a visible output 272 which requests that the consumer verify that the amount entered in the preceding state is correct. The ATM may also be operative to produce an audible output 274 which verbally indicates the current amount entered and requests that the consumer press keys of the keypad to verify that the amount is either correct or incorrect. In this described exemplary embodiment, the consumer may verify the amount by pressing the seven "7" key 276 of the keypad. When the seven "6" key is pressed, the ATM may be operative to produce an audible output 278 that verbally indicates a description of the selection by outputting a word such as "OK."

Figure 10:
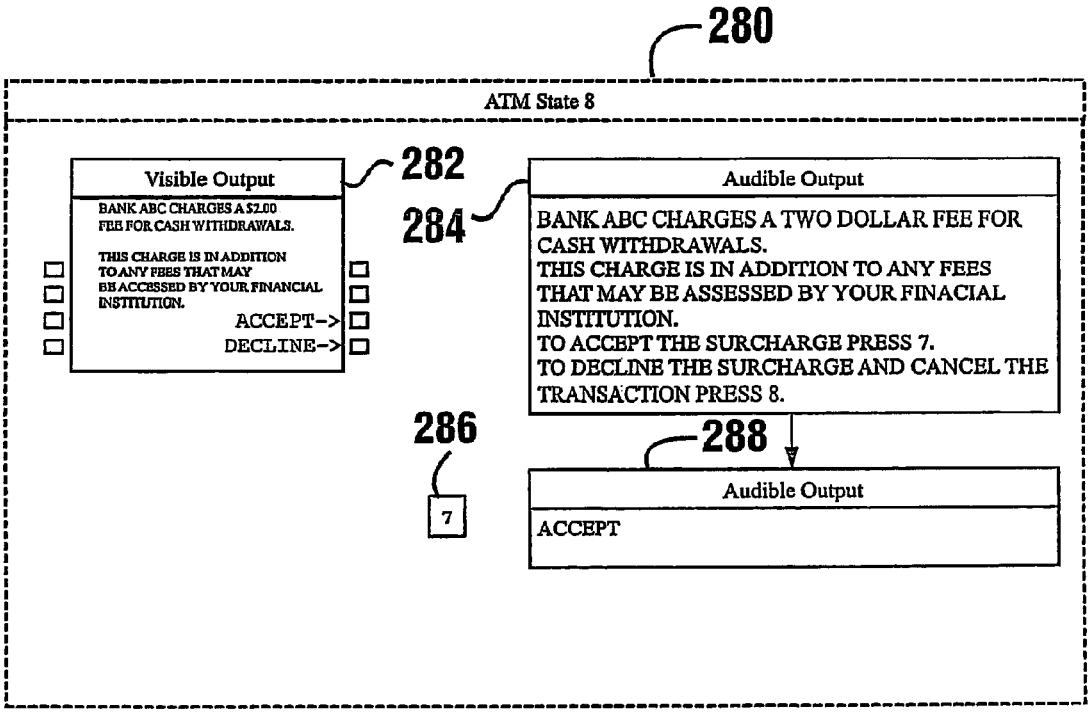

Once an amount has been verified by the consumer, if the ATM is configured to charge a surcharge for the transaction, the ATM may change to a further state such as the eighth state 280 shown in FIG. 10. Here, the exemplary ATM may be operative to produce a visible output 282 which discloses the fee for the withdrawal and requests that the user accept or decline the surcharge. The ATM may further be operative to produce an audible output 284 which verbally describes the fee and indicates which keys of the keypad may be pressed in order to accept or decline the surcharge.

Figure 11:
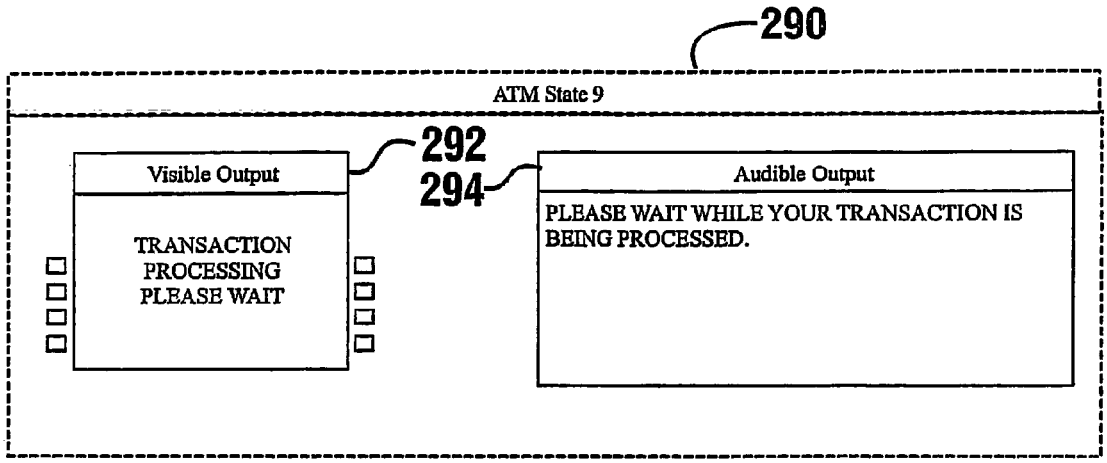
Figure 12:
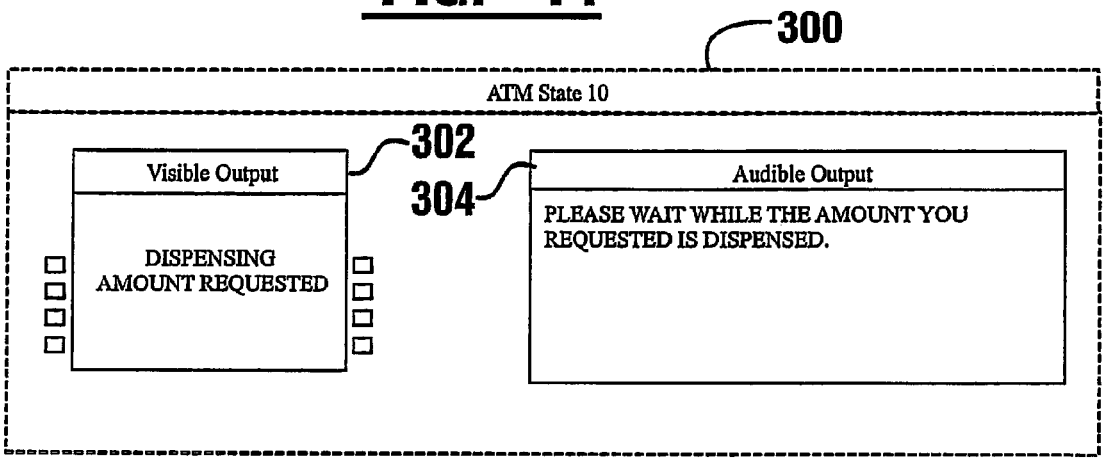

If the consumer accepts the charge by pressing the seven "7" key 286 for example, the ATM may be operative to produce the further audible output 288 which verbally indicates that the user has accepted the surcharge by outputting a word such as "Accept." Once a consumer has accepted the surcharge (if applicable for the transaction), the exemplary ATM may be operative to change to a ninth state 290 represented in FIG. 11 in which the ATM produces both a visible output 292 and an audible output 294 which indicates that the transaction is being processed. Once the withdrawal has been authorized, the ATM may be operative to change to a tenth state 300 represented in FIG. 12. In this state the exemplary embodiment of the ATM may produce both a visible output 302 and an audible output 304 which indicate that the ATM is in the process of dispensing the requested amount.

Figure 13:
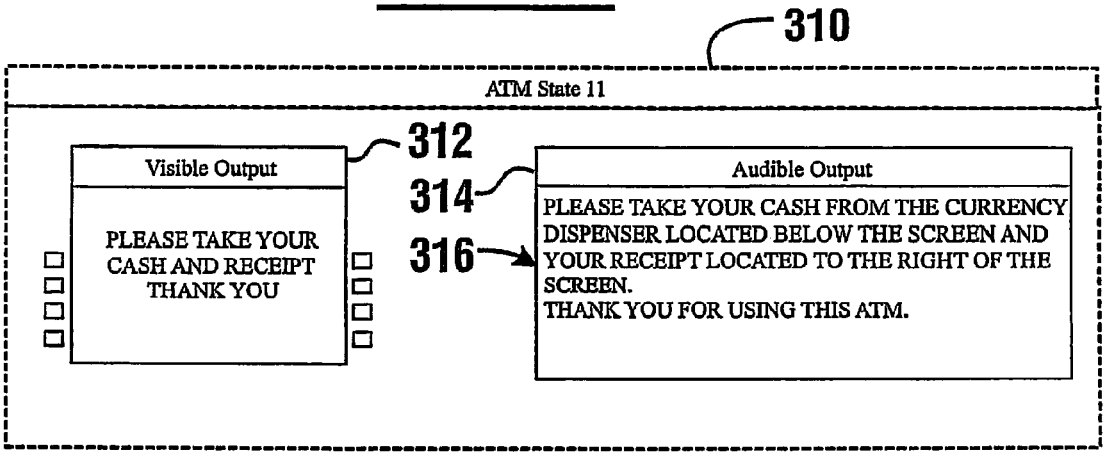

Once the exemplary embodiment of the ATM has dispensed an amount of cash with the cash dispenser that corresponds to the requested amount, the ATM may be operative to change to an eleventh state 310 as represented in FIG. 13. In the eleventh state the ATM may be operative to produce both a visible output 312 and an audible output 314 which indicate that the consumer may take the dispensed amount of cash and a receipt from the ATM. In addition, the verbal instructions 316 of the audible output may further describe the locations of the opening through which cash is delivered and the opening through which a receipt is delivered on the ATM.

Once the transaction function has been completed, the exemplary embodiment of the ATM may return to a previous state such as the described third state 160 shown in FIG. 5 for selecting another transaction or the described first state 102 shown in FIG. 3 for attracting new consumers. It is to be understood that the described ATM states, visible outputs, and audible outputs are examples of performing only one type of transaction with the exemplary embodiment. Other transaction functions for the described ATM and alternative exemplary embodiments of the ATM may have additional and/or other types of ATM states, visible outputs, and audible outputs.

In some exemplary embodiments, pre-existing ATMs which do not offer a user interface for the visually impaired may be upgraded to include some or all of the previously described features. Such an upgrade may include installing new terminal control software that is operative to cause the computer to direct the previously described audible outputs through a sound system device of the ATM. Such upgraded terminal control software may further be operative to cause the ATM to repeat verbal instructions, provide verbal help for selections, and/or change the volume of the audible output as described previously.

Figure 14:
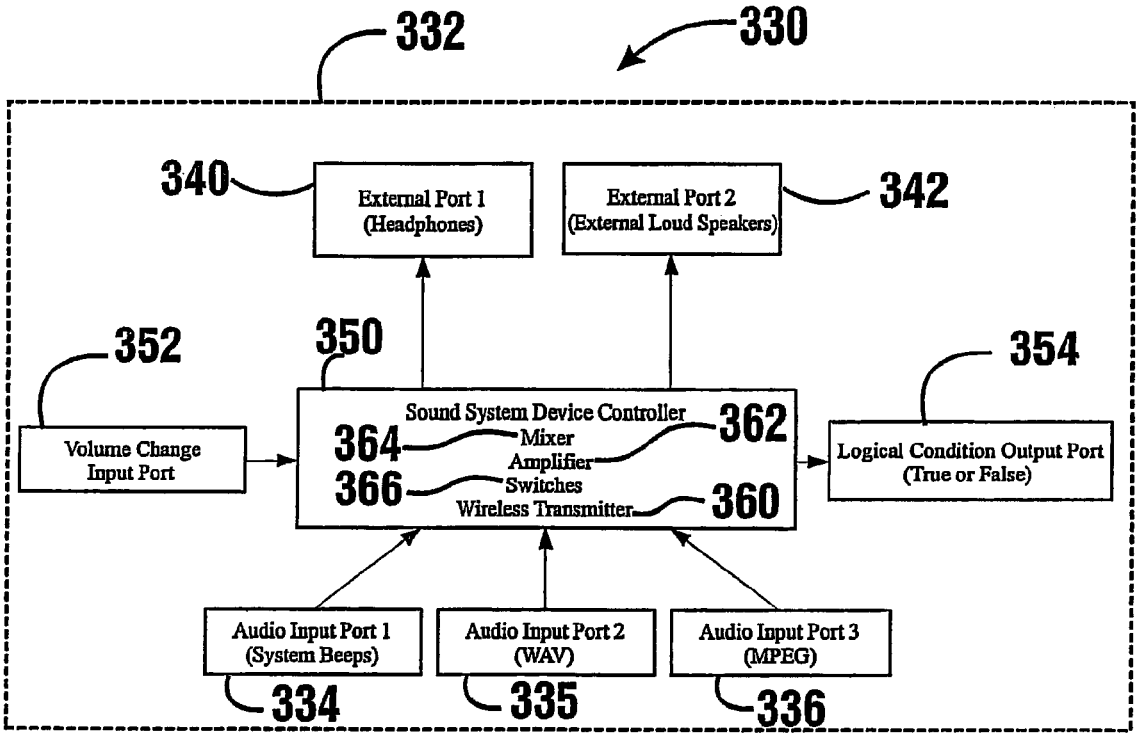
FIG. 14 is a schematic view representative of an exemplary embodiment of an audio system for an ATM.

In addition, such an upgrade of a pre-existing ATM may include the installation of an audio system that is operative to further enable an ATM to have some or all of the previously described features. FIG. 14 shows an example of an audio system 330 which is adapted to provide an ATM with support for headphones 340 using an exemplary embodiment of a sound system device 332. The sound system device 332 may be adapted to accept one or more audio signals through audio input ports 334-336. Such input ports may be connected to the output ports of one or more audio output devices of the ATM. For example, such audio output devices of an ATM may include a sound card that is operative responsive to operation of the computer associated with the ATM to produce sound signals from WAV or MP3 files. In addition, the ATM may include audio output devices for generating audio signals with beeps and other prompting sounds to assist a consumer in operating the ATM. Also, the exemplary ATM may include a text-to-speech synthesizer audio output device and/or software which is operative to produce audio signals with verbal instructions responsive to alphanumeric text-based instructions included in visual display outputs.

The exemplary sound system device 332 may include a controller 350 that is operative to manipulate one or more audio signals individually through the audio input ports 334-336. The controller 350 may include an amplifier 362 and mixing circuits 364 which are operative to selectively amplify and mix the audio input signals together to produce one or more amplified audio signals. Such amplified audio signals may be selectively directed by the controller 350 through one or more of the external ports 340, 342 of the sound system device. In an exemplary embodiment, the external ports 340, 342 correspond to speaker ports that are adapted to releasably connect to headphones and external loudspeakers. In the exemplary embodiment, the sound system device 332 may include one or more selectable adjustable switches 366 such as jumpers, dip switches, or other electronic switches which can be configured to set relative amplification and other characteristics for mixing one or more audio signals received from the audio input ports 334-336.

In an exemplary embodiment of the sound system device 332, the controller may be in operative connection with a volume change input port 352. The volume change input port 352 may be operative to receive electrical signals responsive to the operation of one or more volume controls such as a momentary switch, key, button or other consumer accessible switch. The controller 350 may be configured to cycle through one of a plurality of volume levels responsive to the electrical signals received from the operation of the volume control. The controller 350 may be operative to amplify the amplified audio signals responsive to the currently selected volume level. When the volume level reaches a maximum level, the exemplary controller may be operative to change the volume level to a predetermined minimum level responsive to the next electrical signal received from operation of the volume control.

In this described exemplary embodiment, the ATM may include a volume control such as a button adjacent the keypad which is in operative connection with the volume change input port 352 of the sound system device 332. However, in other exemplary embodiments, the controller may be operative to receive volume changing signals from the computer of the ATM. Terminal control software may be configured to detect events such as the clicking of a pound "#" key of the keypad and cause the computer to output a volume changing signal to the sound system device.

As discussed previously, the sound system device may be operative to mute amplified audio signals being directed through the external port 342 for external loudspeakers, responsive to the sound system device detecting the connection of headphones to the external port 340 for headphones. In an exemplary embodiment the controller 350 may be operatively configured to detect the impedance change across the external port 340 when headphones are electrically connected to the external port. In the exemplary embodiment, when the connection is detected the controller 350 may be operative to switch off any amplified audio signals being directed to the external port 342 for the external loudspeakers.

In addition, upon detection of the connection of the headphones the controller 350 may be operative to change the volume level of the amplified audio signals being directed to the external port 340 for the headphones to a predetermined level selected from one of the plurality of volume levels produced by the sound system device. Such a predetermined level may be configured with a jumper, dip switch, or other selectable switch associated with the sound system device. The predetermined level for example may be set to a volume level that is loud enough to be capable of being heard by almost all consumers, but is sufficiently low to be unlikely to cause discomfort to the majority of consumers using headphones with an ATM.

In the exemplary embodiment, the controller may further be operative to detect when the headphone has been disconnected from the external port 340 for the headphones. When this occurs the controller may be operative to mute the amplified audio signals to the external port 340 for the headphone and institute the delivery of amplified audio signals to the external port 342 for external loudspeakers.

Also, in the exemplary embodiment, the controller 350 may be in operative connection with a logical condition output port 354 that is adapted to communicate with the computer. The controller 350 may be operative responsive to the detection of the headphones connected to the external port 340 for the headphones, to set the logical condition output port 354 to an electrical condition representative of true or on. When the controller 350 detects that the headphones are no longer connected to the external port 340 for headphones, the controller may be operative to set the logical condition output port 354 to an electrical condition representative of false or off.

In the exemplary embodiment, the computer of the ATM may be configured to poll or monitor the condition of the logical condition output port 354. The terminal control software may be configured to turn on or off audible outputs being directed to the audio input ports 334-336 of the sound system responsive to the current condition of the logical condition output port 354. Thus for example, when the headphones are not attached, the exemplary ATM may be configured to output system beeps and other prompting sounds through the external loudspeakers. However, when headphones are connected and the condition of the logical condition output port 354 changes to true or on, the exemplary terminal control software may be programmed to begin producing audio output with verbal instructions for operating the machine which is directed to the headphones.

In further alternative exemplary embodiments, the sound system device may further include a wireless transmitter 360. Such a transmitter may be operatively configured to transmit a wireless audio signal through an external port of the sound system device. Such a wireless audio signal may be received by a wireless receiver of the consumer such as wireless headphones or other suitable external device usable by the consumer for receiving outputs from the ATM.

In alternative embodiments, the wireless audio signal may be encrypted by the ATM to minimize possible eavesdropping on the transaction by a third party. Such encryption may include a handshaking protocol between the ATM and the headphones or other wireless receiver device of the consumer which verifies that the consumer currently accessing the ATM is the only party that can decipher the audio signals in the wireless transmission from the ATM. For example, in one exemplary embodiment, wireless audio signals between the headphones and the ATM may be transmitted using wireless network technology such as BlueTooth or IEEE 802.11. In such embodiments, the ATM may output to each consumer within range of the ATM a verbal message which includes a unique session code. When the consumer has access to the machine, the consumer can enter their unique access code before entering a PIN. Based on the unique access code entered, the ATM may then direct the audio signals related to operating the ATM only to the set of wireless headphones which originally received the access code from the ATM.

In further exemplary embodiments, the ATM may be configured to direct private wireless audio signals to the headphones or other receiver device of the consumer based on information retrieved from the card or other input used to access the ATM by the consumer. For example, such information from or correlated with data on the card or other input may enable the ATM to retrieve or determine a private network address, encryption key, digital certificate, or other information associated with the headphones of the consumer, which may be used by the ATM to establish secure and private communications with head phones or other wireless devices of the consumer.

In further alternative exemplary embodiments, the handshaking protocol between the ATM and the wireless headphones or receiving device used by the consumer may be based on a biometric input received from the consumer currently accessing the ATM. Such biometric input for example may include a fingerprint scan, facial recognition system or other biometric scan of the consumer. The ATM may then selectively send private wireless audio signals only to that set of headphones which is operatively configured with information that corresponds to the biometric input corresponding to the particular user.

The exemplary embodiments of an audible user interface system and method have been described for use with an automated banking machine such as an ATM. However, it is to be understood that one or more of the features described related to providing an audible user interface may also be used in other self-service terminals such as voting machines and kiosks.

As discussed previously, exemplary embodiments of automated banking machines such as ATMs may output verbal instructions in response to alphanumeric text messages 54. Such ATMs may include a text-to-speech device 62 and/or text-to-speech software which is operative to convert the alphanumeric text messages 54 to verbal audible outputs. As discussed previously, such alphanumeric text messages 54 are also referred to herein as text-to-speech data.

The text-to-speech data may be stored in a local data store of the machine. For example, in one exemplary embodiment, text-to-speech data may be included in one or more files stored on a hard drive of the machine. One or more of the text-to-speech files may be associated with visual screen data 52 also stored on the machine for use with generating visible outputs through the display device of the machine. In exemplary embodiments, screen data 52 may specify which text-to-speech files to access for use with generating audible outputs during the display of the visible outputs.

In exemplary embodiments, the text-to-speech data may be transferred to the machine from a remote server such as a host banking system. Although, in exemplary embodiments, host banking system software may be updated to accommodate the transfer of text-to-speech data to ATMs, alternative exemplary embodiments may include a new method of using existing or legacy host banking systems to transfer text-to-speech data to an ATM. Such a method may include providing monitoring software on the ATM which is capable of detecting and retrieving text-to-speech data from legacy messages originally designed for other types of ATM configuration data.

For example, legacy ATM protocols such as Diebold 91x may include messages which are operative to transfer screen data to ATMs from a host banking system. Such legacy protocols for transferring screen data may include attributes which are associated with or are used to label the screen data being transferred using the protocol. Examples of such attributes associated with screen data messages may include a screen name/number and a bank number.

An exemplary embodiment of the described monitoring software may be operative to monitor one or more of such attributes in the screen data messages. Screen data messages which include text-to-speech data may include predefined values for one or more of these attributes which the monitoring software is operative to recognize as indicating that the screen data message includes text-to-speech data. When such predefined attributes are detected the monitoring software is operative to read the text-to-speech data from the screen data messages and store the text-to-speech data on the machine.

In an exemplary embodiment the attributes used to indicate the presence of text-to-speech data in the screen data messages may also be used to specify, label, or describe features of the text-to-speech data. For example the attributes may be used to identify the human language associated with the text-to-speech data (e.g. English or Spanish). Such attributes may also provide information usable by the monitoring software to label or name the text-to-speech data.

For example, the following data may be included in a screen data message sent to an automated banking machine from a host banking system:

015 900 [E]_000 Please select your transaction. For a withdrawal press 1. To make a deposit, press 2. To transfer money, press 3

An exemplary embodiment of the monitoring software may be operative to monitor the attribute associated with the bank number for values which indicate that the screen data message includes text-to-speech data. In this described exemplary embodiment, bank numbers greater than or equal to 900 are used to specify that text-to-speech data is present in the message. When bank numbers greater than or equal to 900 are detected by the monitoring software, the monitoring software may be operative to use the information provided in the screen data message to generate a text-to-speech file.

In an exemplary embodiment, the text-to-speech file generated may be placed in a predetermined and/or configurable directory on the machine. In other exemplary embodiments, the text-to-speech file may be placed in a directory specified by the screen data in the message. For example, in an exemplary embodiment the bank number may be used to specify a name of a directory on the hard drive of the machine to store the text-to-speech file. Each directory may correspond to a different human language, so that all text-to-speech files stored in a particular directory correspond to the same human language.

In the above example, the screen data message includes the bank number of 900. In exemplary embodiments, a bank number with a value of 900 may correspond to a human language such as English. Also, in such exemplary embodiments, a bank number with a value of 901 may correspond to another human language such as Spanish.

When the screen data is associated with the bank number with the value of 900, the monitoring software may be operative to generate and store a corresponding text-to-speech file in a directory reserved for English language text-to-speech files. Whereas, when the screen data is associated with the bank number with the value of 901, the monitoring software may be operative to generate and store a corresponding text-to-speech file in a directory reserved for Spanish language text-to-speech files.

In one exemplary embodiment, text-to-speech directories may include names which correspond to all or portions of the bank number or other attribute which are used to specify the human language of the text-to-speech data. For example, text-to-speech files may be placed in a directory with a name that corresponds to one or more of the digits of its associated bank number. Thus text-to-speech files associated with the bank number of 900 may be placed in a directory with a name such as "lang000," while text-to-speech files associated with the bank number of 901 may be placed in a directory with a name such as "lang001." Likewise, text-to-speech files associated with the bank number of 902 may be placed in a directory with a name such as "lang002." In this described exemplary embodiment, one or more of the digits or other characters which distinguish between the different bank numbers or other attributes may be used in the name of corresponding directories used to store the text-to-speech files.

In exemplary embodiments, other data or attributes associated with the screen data message may be used by the monitoring software to generate a name for the generated text-to-speech file. For example, in the above example, the screen data message includes a screen name attribute with a value of "015." This screen name may be included in the name of the generated text-to-speech file. Also, in the above example, the screen data following the bank number includes a letter "E" in brackets. The monitoring software may also be operative to identify the letter between the brackets following the bank number and use the identified letter in the name of the file.

As a result, the corresponding file name generated by the monitoring software from the above example of a screen data message may include the characters "E015." In exemplary embodiments, the monitoring software may include other characters in the file names such as a descriptive pre-fix and extensions. In one exemplary embodiment, generated text-to-speech files include a prefix such as "TT" and an extension such as "htm." For the above example of screen data, the corresponding text-to-speech file name would be "TTE015.htm."

In exemplary embodiments, the monitoring software may be operative to generate text-to-speech files which include HTML tags, Java script, VB script, XML, and/or other code which is operative to cause the ATM to generate audible outputs responsive to the text-to-speech data stored in the file. For example, in the above example, the screen data following the brackets may correspond to text-to-speech data. The monitoring software may be operative to place this text-to speech data in an HTM file along with HTM tags, Java script and/or other interpreted code which is operative to cause the ATM to process the text-to-speech data with text-to-speech devices 62 and/or software on the machine.

In one exemplary embodiment, the HTM text-to-speech file may reference an Active X control or other external software. The ATM may include a browser or other HTML responsive software which is operative to read the HTM text-to-speech file and in response to the file access and/or send the screen data as an argument to an ActiveX control. The ActiveX control may be programmed to accesses and/or cause the text-to-speech device or software of the ATM to convert the text-to-speech data to corresponding audible outputs.

In the above example, the text-to-speech device and/or software would output verbal instructions representative of the spoken command "Please select your transaction. For a withdrawal press 1. To make a deposit, press 2, To transfer money, press 3."

In an exemplary embodiment, the text-to-speech data may include additional attributes which are not intended to be spoken but are intended to configure the operation of the text-to-speech device and/or software. In the above example, the screen data begins with the four characters "_000." The text-to-speech device and/or software may be responsive to these characters to determine which human language to use when generating verbal instructions from the text-to-speech data. For example, the beginning characters "_000" may correspond to the human language English. As a result, the text-to-speech device and/or software may convert the subsequent text-to-speech data to audible outputs which correspond to an English pronunciation of the text-to-speech data.

In the exemplary embodiment, the terminal control software of the machine may be operative to access the text-to-speech files responsive to screen data files. Thus, when the ATM produces a visible output responsive to a particular screen data file, the screen file may reference an associated text-to-speech file which describes the features of the visible output.

With the above described exemplary embodiment, both visual screen data and associated text-to-speech data can be updated on an ATM using standard or legacy ATM protocols and messages from a host banking system. In addition, for each state of an ATM, screen data and associated text-to-speech data may be downloaded to the PC in multiple languages. Depending on the language preference of the user operating the machine, terminal control software in the ATM is operative to access the screen data and text-to-speech data which corresponds to the language preferred by the user.

In further exemplary embodiments, the monitoring software may be operative to monitor screen messages for the presence of screen data and responsive thereto, saving the screen data in an ASCII text format or other format in a single display screen file on the hard drive of the ATM. Further, the monitoring software may be operative to monitor for the presence of state messages from a host banking system. The monitoring software may be operative responsive to the detection of state message to retrieve state information from the messages and store the state information in a single state file.

In further exemplary embodiments, the monitoring software may be operative to store screen data that comes from a host banking machine in an OAR message or as part of a screen update data field in a function command message.

In exemplary embodiments, HTML code accessible to the ATM for generating user interfaces for operating the ATM may include the use of the "^" symbol or other symbol or tag which causes an HTML responsive program (such as a browser) to access one of the described text-to-speech, display screen, or state files generated by the monitoring software.

For example HTML code for generating a user interface may include the command ^0154. The "^" symbol may be detected by browser accessing the HTML code and in response thereto the browser may access a text-to-speech file such as "TTS154.TXT" from the appropriate language director such as lang000. The text-to-speech file "TTS154.TXT" may have been created by the monitoring software responsive to a screen message as discussed previously. In another example, the "^" or other symbol or tag may reference a display screen file generated using the monitoring software such as the display screen file "SCR035.txt." The data from the display screen file may be incorporated into a visual display screen generated by, the ATM. By referencing such text-to-speech, visual display screen, or state files from HTML code, the ATM can be dynamical updated to display visual or output audible information representative of different surcharge amounts, or low bill denominations without having to alter the programming of the host system software.

A further exemplary embodiment may include a sound configuration software component which is operative to aid a technician with the process of configuring an ATM to provide audible outputs with verbal instruction. In one exemplary embodiment, the sound configuration software may be located on a portable medium such as a CD/DVD disk or other storage medium. The portable medium may be placed in a corresponding reading device of the ATM (e.g. CD/DVD reader) and the sound configuration software may be executed from the portable medium.

In an exemplary embodiment, the sound configuration software may be operative to configure and/or update an ATM to include sound software and/or data necessary to enable the ATM to generate audible outputs with verbal instructions. Such sound software may include text-to-speech synthesizer software, the previously described monitoring software, and/or any other sound system related software or data.

The sound configuration software may also be operative to copy from the portable medium verbal instruction data (e.g., text-to-speech files, WAV files, and/or MP3 files) which corresponds to display screens provided by the ATM which are not typically retrieved from a host. For example, ATMs may include an off-line screen if the ATM is powered on without having a communication connection with a host banking system. ATMs may also include an out of service screen if they have communication with the host established but have not received screen messages from the host. ATMs may also include screens to handle situations where a transaction will require a particular device which is currently being serviced or where the device requires interaction with the user. For these described screens, the sound configuration software may be operative to copy from the portable medium verbal instruction data to the ATM which is operative to cause the ATM to generate audible outputs which verbally describe for these screens.

In addition, manufacturers of ATMs often produce many different models of ATM with different physical shapes and sizes. Different models may have the display screen, keypad, cash dispenser, and other devices positioned in different locations with respect to each other. Further, even for the same model of ATMs, the positions of some devices may be located in a plurality of different positions depending on the preferences of the owner and/or operator of the ATM.

Because the audible outputs from the ATM may include verbal instructions which describe the location of the devices on the ATM, different ATM may require verbal instruction data which is customized to the physical configuration of the ATM.

In this described exemplary embodiment, the sound configuration software may cause the computer of the ATM to output a tutorial which prompts the technician to input information representative of what devices are installed on the ATM and/or where on the ATM the devices are located. For example, not all ATMs include a depository mechanism or coin dispenser. Thus, an exemplary embodiment of the sound configuration software may query the technician to determine whether a depository mechanism or coin dispenser is present. If a depository mechanism is determined by the configuration software to be present, the sound configuration software may further query the technician to determine the location of the depository mechanism relative a fixed point such as the screen or other landmark on the ATM.

In exemplary embodiments, the sound configuration software may further query the technician as to the type of devices installed on the ATM. For example, ATMs may include different types of card readers such as an insert reader, swipe reader, vertical DIP reader, or horizontal DIP reader. An exemplary embodiment of the sound configuration software may be operative to prompt the technician to select which type of card reader is installed.

Based on the answers provided by the technician, the sound configuration software may copy data files from the portable medium to the hard drive of the ATM which are operative to correctly configure the ATM to provide audible outputs customized to the physical configuration of the ATM. As a result, after the sound configuration software has configured the ATM, the ATM may be operative to provide audible outputs with verbal instructions which accurately describe the locations of devices (e.g., "to the right of the monitor") and their method of use (e.g., "insert card" or "swipe card vertically").

In an exemplary embodiment, the answers provided by the technician associated with the location and/or type of devices installed on the ATM may be stored in a data store on the ATM. A tutorial included with the sound configuration software may present configuration options for the sound software being configured responsive to the data in this data store. In exemplary embodiments, this data store may remain on the hard drive of the ATM. Thus the next time the sound configuration software is executed from the portable medium, the tutorial may proceed using the data provided by the technician previously rather than forcing the technician to re-answer each question regarding the location and/or type of devices on the ATM. However, exemplary embodiments of the sound configuration software may also enable the technician to update the data stored in the data store as needed.

In further exemplary embodiments, the portable medium may be customized for different customers of the manufacturer of the ATMs. For example, a customer may have a relatively small set of combinations of ATM models and associated devices. For this customer, a custom portable medium may be created which includes sound configuration software which prompts the user with questions specific to the range of ATM models and associated devices the customer is expected to have. Thus if the customer only has insert type card readers, the sound configuration software on the customer specific portable medium may be operative to not prompt the technician as to the type of card reader installed on the ATM. Further, the customer specific portable medium may include audible output data which generates audible outputs specific to the customer. For example, a text-to-speech file associated with a welcome screen of the ATM may include the name of the customer (e.g., "Welcome to Bank XYZ").

As discussed previously, the ATM may be operative to provide audible outputs with verbal instructions which describe the locations of devices such as the card reader, cash dispenser, check depository or any other device accessible to a user of the machine. However, a description of a location of a device often includes a reference to a known device or other landmark. For example, a verbal instruction may state, "Insert card into card reader located to the right of the screen." However, unless the user knows where the screen is located, the card reader may be difficult to find by someone who is visually impaired. Alternatively, a verbal instruction may describe the location of a device with reference to commonly known directions, such as, "Insert card into card reader located at 3 o'clock." However, the generic angle "3 o'clock' may correspond to a different location on the ATM for someone who is six feet tall compared to someone who is 5 feet tall.

An exemplary embodiment is operative to further assist the user with locating a device through use of verbal instructions by providing feedback regarding the current location of the user's hand, finger(s), arm or other portion of the user's body. In this described embodiment, the ATM may include a plurality of proximity sensors adjacent a plurality of different devices and/or locations on the ATM. When a sensor adjacent a particular device detects the presence of an object and/or motion adjacent the device, the ATM is operative to output an audible output with spoken information that provides information indicating that the hand or other portion of the user is adjacent to or is moving near the particular device.

In an embodiment, an ATM may include sensors adjacent the card reader, cash dispenser, display screen, keypad, receipt printer, depository mechanism, headphone jack, and/or other devices and may be operative to output the particular name of one these devices when a user's hand or other portion of the user moves adjacent thereto. For example, when a user moves his/her hand or other portion of the user adjacent one of these devices, such as the cash dispenser, a sensor adjacent the cash dispenser may detect the presence of the user's hand or other portion of the user. Responsive to the detection of the user's hand or other portion of the user by the sensor, the ATM may cause a speaker to produce an audible output representative of the name associated with the respective device associated with the sensor, such as "cash dispenser" for a cash dispenser device.

In this described exemplary embodiment, the ATM may include data such as text-to-speech data or audio files which are operative to produce the names or descriptions of each of the devices adjacent the sensors on the ATM. The text-to-speech data or audio files may also include the names or descriptions of devices for a plurality of different languages. Thus responsive to the human language (e.g. English, Spanish, French, Japanese) selected at the ATM by the user or otherwise associated with the user, the ATM may output the names of the devices in the preferred human language of the user.

In an exemplary embodiment, while the user is performing a transaction with the ATM, when the user moves his/her hand or other portion of the user from device to device, the ATM may output the name of each device regardless of whether the device is needed for the particular state of the ATM. However, the ATM may also be operative to selectively enable only one or a subset of sensors which trigger the output of the name of an adjacent device. For example, while the ATM is in a state which displays an initial welcome screen such as "Welcome to Bank XYZ," when a sensor adjacent the headphone jack detects a user's hand or other portion of the user adjacent thereto, the ATM may output through an external speaker of the ATM the name "headphone jack" or another sound identifying the headphone jack. However, during this state the ATM may refrain from outputting the names or other sounds identifying other devices such as a cash dispenser.

Thus, to initially find the headphone jack, a visually impaired user only needs to move his/her hand or other portion of the user adjacent different portions of the fascia of the ATM. When the hand or other portion of the user is near the headphone jack, the ATM will automatically output an audio output such as "headphone jack" or other sound so that the user is informed that the headphone jack is currently near the location of the user's hand or other portion of the user.

Upon insertion of the user's headphones, the state of the ATM may change to that which outputs an audible output through the headphones including a verbal command which instructs the user to insert a card into or swipe a card through the card reader. For this state, the ATM may only enable the sensor adjacent to the card reader and may disable the sensors adjacent the headphone jack and/or other devices. Thus only the sensor adjacent the card reader may be operative to cause the machine to output the name of the "card reader" when the user's hand or other portion of the user is adjacent the card reader.

In this described embodiment, The ATM may only output the names of those devices which provide functions during a particular state of the ATM. In some embodiments, although the ATM may not output the names for all of the devices, the ATM may still output the names for more than one device for a particular state. For example, with respect to a state of the ATM which outputs the command to insert an envelope or check into a depository mechanism of the ATM, the name "depository" may be outputted responsive to the user's hand or other portion of the user adjacent to the depository mechanism. However, in this state, the keypad of the ATM may still be operative to perform functions such as: to cancel the current operation of using the depository; to repeat the command instruction; or to adjust the volume of the audible outputs as described previously. Thus even though the state is primarily directed to using the depository mechanism, the ATM may still output the name "keypad" responsive to the user's hand or other portion of the user moving adjacent the keypad. However, other devices such as the cash dispenser or receipt printer may not be active during this state of the ATM. As a result, the ATM would not be operative to output the names of "cash dispenser" or "receipt printer" when the user's hand or other portion of the user is adjacent one of these devices.

In this described exemplary embodiment, when a sensor initially detects the presence of a hand or other portion of a user, the ATM may output the name of the associated device. If the user's hand or other portion of the user remains adjacent the device, the ATM may refrain from repeating the name of the device. However, if the sensor ceases to detect a portion of the user adjacent the device and then again detects the presence of a portion of the user, the ATM may again output the name of the device. In an alternative exemplary embodiment, the ATM may refrain from repeating the name of the same device multiple times in a row. Thus, if the user moves his/her hand or other portion of the user to and from the keypad multiple times without moving his/her hand or other portion of the user adjacent another device, the ATM may refrain from repeating the name of the keypad each time the hand or other portion of the user returns to the keypad.

In addition to or instead of outputting the name of the nearest device to a sensor, the ATM may output location information associated with the relative location of the sensor. For example, if a sensor is located at the top center of the fascia of the ATM, when a user's hand or other portion of the user passes adjacent to the sensor, the ATM may provide an audible output such as "top center" or "12 o'clock". Likewise, if a sensor is located at the lower left hand corner of the fascia of the ATM, when a user's hand or other portion of the user passes adjacent to the sensor, the ATM may provide an audible output such as "lower left" or "4 o'clock".

In an exemplary embodiment, the proximity sensors may correspond to optical sensors operative to detect changes in light caused by the hand in other portion of the user adjacent the sensor. FIG. 16 shows an example of an optical proximity sensor 420 adjacent to or included with a device 432 of the ATM. In this exemplary embodiment, the sensor 420 may comprise a light emitter 422 operative to emit light 426 outwardly from the fascia 19 of the ATM 10. The sensor may also comprise a light detector 424 operative to detect portions of the light 428 emitted from the light source upon being reflected back towards the sensor by the presence of a portion of the user's body 430.

In other embodiments the sensor may comprise a light detector operative to detect when the amount of light decreases as a result of the hand or other portion of the user at least partially blocking light from reaching the light detector. In a further exemplary embodiment, the sensor may comprise a light detector operative to detect when light from a light emitter not adjacent the sensor is either reflected back towards the light detector or is at least partially blocked from reaching the light detector. Such a non-adjacent light emitter may correspond to a light source which illuminates the fascia of the ATM, located either on or off the ATM. For example as shown in FIG. 15, such a light emitter that is not adjacent a sensor for a device may include the overhead or task light 404 operative to emit light downwardly onto the fascia 19 of the ATM.

In an exemplary embodiment, some of the devices of the ATM may include one or more light emitters such as LEDs which are turned on in a continuous or flashing (repeating on-off) manner to assist a user in visually finding a device which is operative for use with the current state. Such light emitters are referred to in the art as "lead-through indicators." For example, when the receipt printer is activated to print a receipt, the ATM and/or receipt printer may cause LEDs adjacent to and/or surrounding the slot through which the printed receipt exits the card reader to light up and/or flash. After the user takes the receipt, or after a predetermined amount of time, the ATM and/or receipt printer may turn the LEDs off and/or stop the LEDs from flashing. Selectively activating the lighting or flashing of the lead-through indicators adjacent various devices assists in visually leading a sighted user to find the correct device to which the user must take some action (e.g., take the receipt).

In FIG. 15, such lead through indicators are identified with reference numerals 400 and 402 adjacent the cash dispenser 20 and receipt printer 24, respectively. Such lead-through indicators may comprise a plurality of LEDs aligned in a row or grid and may be positioned behind a clear plastic lens. In this described embodiment, the LEDs of the lead-through indicators may be mounted to the device. However in other embodiments, the lead-through indicators may be mounted to the fascia 19 adjacent the location of the device.

In an exemplary embodiment of the proximity sensors for detecting the presence of a hand or other portion of a user adjacent devices of the ATM, the sensors may be incorporated into the lead-through indicators of the devices. For example, the LEDs of the lead-through indicators may correspond to the previously described light emitters 422. As shown in FIG. 16, one or more light detectors 424 may be located adjacent the light emitters 422 of a lead-through indicator of a device 432 of the ATM. The sensor and/or associated circuitry and/or a processor in the ATM may be responsive to the change in the detected amount of light surpassing a pre-determined threshold to cause the ATM to output an audio output which verbally conveys the name of the device associated with the sensor.

In an exemplary embodiment, to reduce the effects that ambient light may have on the sensor, the sensor may be operative to look for specific properties associated with the light emitted by the light emitter 422. Such properties may include a specific wavelength of light that is unique to the light emitter 422. Such properties may also include having the emitter vary the intensity of the light 422 with a specific pattern. By monitoring for properties such as intensity changes that vary in a manner that corresponds to the pattern associated with the light 422 emitted from the light emitter, the sensor may avoid triggering audible outputs caused by changes in ambient light which do not have such a pattern or other properties. In a further exemplary embodiment, the light emitters associated with different devices may emit light with different variable intensity patters to minimize stray reflected light from one device triggering an audible output associated with another device. An example of a light emitter and detector configured to output and detect respectively light signals with unique intensity patterns is shown in U.S. Pat. No. 6,896, 181 B2 which is hereby incorporated herein by reference.

In an exemplary embodiment, the light emitted and detected may be in the visible light spectrum. However, in other exemplary embodiments, other frequencies of light may be used to activate the sensor such as infrared. Also, a device may include a plurality of light emitters such as the plurality LEDs associated with lead-through indicators. However, in exemplary embodiments, not all of the light emitters may be configured to output light 422 with the specific wavelength and/or variable intensity pattern that triggers an audible output when detected by a light detector. For example, some of the light emitters may be in a visible light spectrum and function only as lead-through indicator lights. However, among these visible light emitters may be infrared light emitters. In this described embodiment, an audible output may be triggered responsive to the detection of the infrared light and not the visible light.

Although proximity sensors which detect changes in light have been described, it is to be understood that in alternative exemplary embodiments other forms of proximity sensors may be used to detect the hand, finger(s), arm or other portion of the user adjacent a device of the ATM. For example, a sensor that detects sound waves may be used to acoustically detect the presence of a portion of a user. Such a proximity sensor may include a sound emitter that outputs at least one sound wave (e.g. an ultrasonic frequency sound) and/or at least one sound wave with a particular pattern. The proximity sensor may further include a sound detector that is operative to detect changes in the emitted sound wave that are indicative of a portion of a persons body being adjacent the proximity sensor.

Also, in alternative exemplary embodiments, a proximity detection sensor may include a sensor or a touch pad operative to detect changes in capacitance or changes in other electromagnetic properties caused by a portion of the user being near the sensor and/or caused by the user touching the sensor. As with the previously described light based proximity detection sensors, these alternative proximity detection sensor mays be used to trigger an audible output by the ATM which verbally names a nearby device or otherwise provides an audible sound useful to identify the location of a person's hand or other portion of the user relative to different portions of an ATM.

Thus, as used herein and in the claims, a proximity sensor shall comprise any type of sensor device that can be used to trigger an audible output responsive to an object (such as a hand or other portion of a user) placed or moved relatively closer to the sensor than proximity sensors associated with other devices located on the ATM.

Although the described methods of providing audible feedback responsive to the location of a portion of a users body has been described for use with an ATM, it is to be understood that in alternative embodiments, the described system and method for providing audible feedback may be applied to other types of self-service terminals. Such other types of self-service terminals may include kiosks, voting machines, ticket dispensers, vending machines, or any other terminal which includes a plurality of user accessible devices.

Thus at least one embodiment of an automated banking machine audible user interface system and method described herein achieves one or more of the above stated objectives, eliminates difficulties encountered in the use of prior devices and systems, solves problems and attains the desirable results described herein.

In the foregoing description certain terms have been used for brevity, clarity and understanding; however, no unnecessary limitations are to be implied therefrom because such terms are used for descriptive purposes and are intended to be broadly construed. Moreover, the descriptions and illustrations herein are by way of examples, and the invention is not limited to the exact details shown and described.

In the following claims, any feature described as a means for performing a function shall be construed as encompassing any means known to those skilled in the art to be capable of performing the recited function, and shall not be limited to the features and structures shown herein or mere equivalents thereof. The description of the exemplary embodiment included in the Abstract included herewith shall not be deemed to limit the invention to features described therein.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims.

I claim:

1. Apparatus comprising:

an automated banking machine including:

at least one computer;

at least one output device in operative connection with the at least one computer;

a plurality of user accessible devices that each include a respective indicator device that includes a respective proximity sensor thereon, wherein each user accessible device, indicator device, and proximity sensor is in operative connection with the at least one computer, wherein each proximity sensor is operative to detect when at least one portion of a machine user is adjacent the respective proximity sensor, wherein each indicator device includes a plurality of LEDs that are operative to emit visible light, wherein the user accessible devices include a cash dispenser and a card reader;

wherein during a portion of a transaction that involves use of a first one of the user accessible devices and does not involve use of a second one of the user accessible devices, the at least one computer is operative to:

cause a first indicator device included with the first user accessible device to repeatedly flash the LEDs of the first indicator device;

cause the at least one computer to be operative responsive to a first proximity sensor included with the first indicator device detecting at least one portion of the machine user adjacent the the first user accessible device, to cause at least one audio output corresponding to the first user accessible device to be outputted through the at least one output device;

not cause a second indicator device included with the second user accessible device to repeatedly flash the LEDs of the second indicator device; and not cause the at least one computer to be operative responsive to a second proximity sensor included with the second indicator device detecting at least one portion of the machine user adjacent the second user accessible device, to cause at least one audio output corresponding to the second user accessible device to be outputted through the at least one output device.

2. The apparatus according to claim 1, wherein the at least one audio output includes verbal information operative to identify the respective user accessible device the at least one portion of a machine user is adjacent.

3. The apparatus according to claim 2, wherein the verbal information includes an identifying name for the respective user accessible device.

4. The apparatus according to claim 1, wherein the at least one output device includes an external port in operative connection with the at least one computer, wherein the external port is releasably operatively engageable with a portable speaker device, whereby a machine user performing a transaction with the automated banking machine is enabled to operatively connect the portable speaker device to the automated banking machine through the external port.

5. The apparatus according to claim 4, and further comprising the portable speaker device, wherein the portable speaker device includes a headphone.

6. The apparatus according to claim 4, wherein the plurality of user accessible devices includes the external port.

7. The apparatus according to claim 1, wherein the cash dispenser includes a cash outlet from which cash is dispensed, and wherein the plurality of user accessible devices includes the cash outlet of the cash dispenser.

8. The apparatus according to claim 1, wherein the plurality of user accessible devices includes a card reader.

9. The apparatus according to claim 1, wherein the plurality of user accessible devices includes an input key.

10. The apparatus according to claim 1, wherein the plurality of user accessible devices includes a keypad.

11. The apparatus according to claim 1, wherein the plurality of user accessible devices includes a deposit device inlet.

12. The apparatus according to claim 1, wherein the at least one portion of a machine user includes a user finger.

13. The apparatus according to claim 1, wherein the first proximity sensor is operative to detect the at least one portion of the machine user responsive to light reflected off of the at least one portion of the machine user, which light is originally emitted from at least on LED of the first indicator device.

14. The apparatus according to claim 1, wherein at least one proximity sensor associated with a respective at least one user accessible device is operative to detect at least one portion of a machine user adjacent the respective at least one user accessible device without the at least one portion of the machine user touching the respective at least one user accessible device.

15. A method comprising:

a) operating at least one computer in a cash dispensing automated banking machine to cause the automated banking machine to be in a first state of operation, wherein the automated banking machine includes a first user accessible device and a second user accessible device, wherein the first user accessible device includes a first proximity sensor, wherein the second user accessible device includes a second proximity sensor, wherein the automated banking machine includes at least one output device;

b) detecting with the first proximity sensor that at least one portion of a user is adjacent to the first user accessible device;

c) through operation of the at least one computer responsive to both (a) and (b) concurrently, outputting through the at least one output device a first audio output corresponding to the first user accessible device;

d) operating the at least one computer to cause the automated banking machine to be in a second state of operation;

e) detecting with the second proximity sensor that at least one portion of the user is adjacent to the second user accessible device;

f) through operation of the at least one computer responsive to both (d) and (e) concurrently, outputting through the at least one output device a second audio output corresponding to the second user accessible device; and g) through operation of the at least one computer responsive to (d), not causing an output through the at least one output device that is responsive to detecting with the first proximity sensor that at least one portion of the user is adjacent to the first user accessible device.

16. The method according to claim 15, wherein the first audio output includes first verbal information including a first user accessible device identifying name.

17. The method according to claim 15, wherein (c) and (f) include outputting the first audio output and the second audio output through an external port on the machine, wherein the external port is releasably operatively engageable with portable speaker devices usable by persons performing transactions with the machine.

18. The method according to claim 17, wherein (c) and (f) include outputting the first audio output and the second audio output through a headphone placed in operative engagement with the external port of the machine.

19. The method according to claim 17, wherein in (a) at least one of the first and second user accessible devices includes the external port.

20. The method according to claim 15, wherein in (a) the first user accessible device includes a cash dispenser outlet.

21. The method according to claim 15, wherein in (a) the first user accessible device includes a card reader.

22. The method according to claim 15, wherein in (a) the first user accessible device includes an input key.

23. The method according to claim 15, wherein in (a) the first user accessible device includes a keypad.

24. The method according to claim 15, wherein in (a) the first user accessible device includes a deposit device inlet.

25. The method according to claim 15, wherein in (a) the at least one user portion includes a user finger.

26. The method according to claim 15, wherein (b) includes detecting that at least one portion of a user is adjacent the first user accessible device without the at least one portion of the user touching the first user accessible device.

27. At least one article of computer readable media bearing computer executable instructions operative to cause at least one computer in a cash dispensing automated banking machine to cause the machine to carry out a method comprising:

a) operating the at least one computer to cause the automated banking machine to be in a first state of operation, wherein the automated banking machine includes a first user accessible device and a second user accessible device, wherein the first device includes a first proximity sensor, wherein the second device includes a second proximity sensor, wherein the automated banking machine includes at least one output device;

b) detecting with the first proximity sensor that at least one portion of a user is adjacent to the first user accessible device;

c) through operation of the at least one computer responsive to both (a) and (b) concurrently, outputting through the at least one output device a first audio output corresponding to the first user accessible device;

d) operating the at least one computer to cause the automated banking machine to be in a second state of operation;

e) detecting with the second proximity sensor that at least one portion of the user is adjacent to the second user accessible device;

f) through operation of the at least one computer responsive to both (d) and (e) concurrently, outputting through the at least one output device a second audio output corresponding to the second user accessible device; and g) through operation of the at least one computer responsive to (d), not causing an output through the at least one output device that is responsive to detecting with the first proximity sensor that at least one portion of the user is adjacent to the first user accessible device.

28. A method comprising:

a) operating at least one computer in a cash dispensing automated banking machine to cause the automated banking machine to be in a first state of operation, wherein the automated banking machine includes a first device and a second device, wherein the first device includes a first indicator device and a first proximity sensor on the first indicator device, wherein the second device includes a second indicator device and a second proximity sensor on the second indicator device, wherein the first indicator device includes a plurality of LEDs operative to emit visible light, wherein the second indicator device includes a plurality of LEDs operative to emit visible light;

b) detecting with the first proximity sensor that at least one portion of a user is adjacent to the first device on the automated banking machine, wherein the first device is operative to at least one of: receive at least one user input to the machine; provide at least one output from the machine; and provide at least one item from the machine;

c) through operation of the at least one computer responsive to both (a) and (b) concurrently, outputting through at least one output device a first audio output, wherein the first audio output includes first verbal information including a first device identifying name;

d) through operation of the at least one computer responsive to (a) only, repeatedly flashing the LEDs of the first indicator device;

e) operating the at least one computer to cause the automated banking machine to be in a second state of operation;

f) detecting with the second proximity sensor that at least one portion of the user is adjacent to the second device on the automated banking machine;

g) through operation of the at least one computer responsive to both (e) and (f) concurrently, outputting through the at least one output device a second audio output, wherein the second audio output includes second verbal information including a second device identifying name; and h) through operation of the at least one computer responsive to (e), repeatedly flashing the LEDs of the second indicator device.

29. The method according to claim 28, wherein (c) and (g) include outputting the first audio output and the second audio output through an external port on the machine, wherein the external port is releasibly operatively engageable with portable speaker devices usable by persons performing transactions with the machine.

30. The method according to claim 29, wherein (c) and (g) include outputting the first audio output and the second audio output through a headphone placed in operative engagement with the external port of the machine.

31. The method according to claim 28, wherein in (a) the first device includes a cash dispenser outlet.

32. The method according to claim 28, further comprising:

i) through operation of the at least one computer responsive to (e), stopping the LEDs of the first indicator device from repeatedly flashing;

j) through operation of the at least one computer responsive to (e), not causing an output through the at least one output device that is responsive to detecting with the first proximity sensor that at least one portion of the user is adjacent to the first device.

33. The method according to claim 32, wherein in (a) the second device includes a card reader.

34. The method according to claim 32, wherein (d) occurs during (b), wherein (b) includes detecting with the first proximity sensor the at least one portion of the user responsive to light reflected off of the at least one portion of the user, which light is originally emitted from at least one LED of the first indicator device.

35. The method according to claim 28, further comprising:

responsive to (e), outputting through the at least one output device a third audio output, wherein the third audio output includes at least one first verbal instruction to operate the second device.

36. The method according to claim 28, wherein (b) includes detecting that at least one portion of a user is adjacent the first device without the at least one portion of the user touching the first device.

37. At least one article of computer readable media bearing computer executable instructions operative to cause at least one computer in a cash dispensing automated banking machine to cause the machine to carry out a method comprising:

a) operating the at least one computer in the automated banking machine to cause the automated banking machine to be in a first state of operation, wherein the automated banking machine includes a first device and a second device, wherein the first device includes a first indicator device and a first proximity sensor on the first indicator device, wherein the second device includes a second indicator device and a second proximity sensor on the second indicator device, wherein the first indicator device includes a plurality of LEDs operative to emit visible light, wherein the second indicator device includes a plurality of LEDs operative to emit visible light;

b) detecting with the first proximity sensor that at least one portion of a user is adjacent to the first device on the automated banking machine, wherein the first device is operative to at least one of: receive at least one user input to the machine; provide at least one output from the machine; and provide at least one item from the machine; and c) responsive to both (a) and (b) concurrently, outputting through at least one output device a first audio output, wherein the first audio output includes first verbal information including a first device identifying name;

d) through operation of the at least one computer responsive to (a), repeatedly flashing the LEDs of the first indicator device;

e) operating the at least one computer to cause the automated banking machine to be in a second state of operation;

f) detecting with the second proximity sensor that at least one portion of the user is adjacent to the second device on the automated banking machine;

g) responsive to both (e) and (f) concurrently, outputting through the at least one output device a second audio output, wherein the second audio output includes second verbal information including a second device identifying name;

h) through operation of the at least one computer responsive to (e), repeatedly flashing the LEDs of the second indicator device.

* * * * *